US011974634B2

(12) United States Patent
Kilgore

(10) Patent No.: US 11,974,634 B2
(45) Date of Patent: May 7, 2024

(54) HEEL STRUCTURE WITH LOCATING PEGS AND METHOD OF MANUFACTURING AN ARTICLE OF FOOTWEAR

(71) Applicant: NIKE, Inc., Beaverton, OR (US)

(72) Inventor: Elizabeth A. Kilgore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/895,188

(22) Filed: Aug. 25, 2022

(65) Prior Publication Data

US 2022/0400816 A1 Dec. 22, 2022

Related U.S. Application Data

(60) Continuation of application No. 16/894,266, filed on Jun. 5, 2020, now Pat. No. 11,470,919, which is a (Continued)

(51) Int. Cl.

| | |
|---|---|
| ***A43B 23/20*** | (2006.01) |
| ***A43B 23/02*** | (2006.01) |
| ***A43B 23/08*** | (2006.01) |

(52) U.S. Cl.

CPC ..... *A43B 23/028* (2013.01); *A43B 23/0235* (2013.01); *A43B 23/088* (2013.01); *A43B 23/20* (2013.01)

(58) Field of Classification Search

CPC ..... A43B 23/0235; A43B 23/028

(Continued)

(56) References Cited

U.S. PATENT DOCUMENTS

| | | | | |
|---|---|---|---|---|
| 91,547 A | | 6/1869 | Leathe | |
| 112,439 A | * | 3/1871 | Francis | A43B 3/16 36/138 |

(Continued)

FOREIGN PATENT DOCUMENTS

| | | |
|---|---|---|
| CN | 2138904 Y | 7/1993 |
| CN | 2438353 Y | 7/2001 |

(Continued)

OTHER PUBLICATIONS

Non-Final Office Action received for U.S. Appl. No. 17/950,814, dated Apr. 6, 2023, 8 pages.

(Continued)

*Primary Examiner* — Timothy K Trieu

(74) *Attorney, Agent, or Firm* — Shook, Hardy & Bacon L.L.P.

(57) ABSTRACT

A footwear article includes an upper defining apertures spaced apart from one another in a first arrangement. A heel structure has a deformable element attached to a base. The deformable element has pegs spaced apart from one another in the first arrangement and extending through the apertures in the upper. A method of manufacturing a footwear article includes placing a deformable element between an inner layer and an outer layer of an upper and attaching the deformable element to a rigid base. The deformable element includes at least one peg extending outward toward the outer layer. The method includes inserting the peg through the outer layer so that the peg extends through the outer layer and is exposed at an exterior surface of the outer layer. After inserting the peg of the footwear element through the outer layer of the upper, the peg is secured at the exterior surface of the outer layer.

8 Claims, 12 Drawing Sheets

Related U.S. Application Data division of application No. 16/235,377, filed on Dec. 28, 2018, now Pat. No. 10,721,994.

(58) Field of Classification Search
USPC ..... 36/45
See application file for complete search history.

(56) References Cited

U.S. PATENT DOCUMENTS 219,436 A 9/1879 Beneke
487,860 A 12/1892 Vail
827,330 A 7/1906 Tillson
863,549 A 8/1907 Metz
882,109 A 3/1908 Harris
905,323 A 12/1908 King et al.
911,025 A 2/1909 Blaisdell
1,028,598 A 6/1912 Papp
1,081,678 A 12/1913 Langerak
1,155,354 A 10/1915 Hallock
1,464,342 A 8/1923 Rothacher
1,494,236 A 5/1924 Greathouse
1,515,086 A 11/1924 Baluta
1,686,175 A 10/1928 Read
1,972,899 A 9/1934 Odell
D98,150 S 1/1936 Drake
2,069,752 A 2/1937 Dorr
2,097,810 A 11/1937 Dawes
2,450,250 A 9/1948 Napton
2,452,502 A 10/1948 Tarbox
2,513,005 A 6/1950 Nancy
2,523,221 A 9/1950 Craven
2,619,744 A * 12/1952 Mattes ..... A43B 3/30 36/105
2,736,110 A 2/1956 Hardimon
2,920,402 A 1/1960 Minera
2,942,359 A 6/1960 Bushway et al.
3,146,535 A 9/1964 Owings
3,192,651 A 7/1965 Smith
1,275,895 A 8/1981 Fox
4,489,509 A 12/1984 Libit
4,608,769 A 9/1986 Sturlaugson
4,685,223 A 8/1987 Long
4,876,806 A 10/1989 Robinson et al.
4,972,613 A 11/1990 Loveder
5,054,216 A 10/1991 Lin
5,090,140 A 2/1992 Sessa
5,152,082 A 10/1992 Culpepper
5,181,331 A 1/1993 Berger
5,184,410 A 2/1993 Hamilton
5,279,051 A 1/1994 Whatley
5,282,327 A 2/1994 Ogle
5,317,819 A 6/1994 Ellis
5,341,583 A 8/1994 Hallenbeck
5,371,957 A 12/1994 Gaudio
5,406,721 A 4/1995 Marcolin
5,467,537 A 11/1995 Aveni et al.
5,481,814 A 1/1996 Spencer
5,826,353 A 10/1998 Woznicki
5,842,292 A 12/1998 Siesel
5,926,978 A 7/1999 Smith
5,933,986 A 8/1999 Donnadieu
6,000,148 A 12/1999 Cretinon
6,180,606 B1 1/2001 Chen et al.
6,189,239 B1 2/2001 Gasparovic et al.
6,298,582 B1 10/2001 Friton et al.
6,314,662 B1 11/2001 Ellis
6,360,454 B1 3/2002 Dachgruber et al.
6,378,230 B1 4/2002 Rotem et al.
6,497,058 B2 12/2002 Dietrich et al.
6,557,271 B1 5/2003 Weaver, III
6,578,288 B2 6/2003 Bernstein
6,684,533 B1 2/2004 Su
6,874,255 B2 4/2005 Bernstein
6,880,272 B2 4/2005 Wells
6,925,732 B1 8/2005 Clarke
6,938,361 B2 9/2005 Su
7,082,702 B2 8/2006 Cretinon
7,103,994 B2 9/2006 Johnson
7,225,563 B2 6/2007 Chen et al.
7,392,603 B1 7/2008 Shepherd et al.
7,439,837 B2 10/2008 Mcdonald
7,685,747 B1 3/2010 Gasparovic et al.
7,793,438 B1 9/2010 Busse et al.
7,823,299 B1 11/2010 Brigham
7,975,403 B2 7/2011 Mosher
8,020,317 B1 9/2011 Sokolowski
D648,512 S 11/2011 Schlageter et al.
8,056,264 B2 11/2011 Sato et al.
8,065,819 B2 11/2011 Kaufman
8,161,669 B2 4/2012 Keating
8,245,421 B2 8/2012 Baudouin et al.
8,769,845 B2 7/2014 Lin
8,850,722 B2 10/2014 Baker et al.
9,192,204 B1 11/2015 Liles et al.
9,820,527 B2 * 11/2017 Pratt ..... A43B 23/28
9,867,426 B2 1/2018 Conant et al.
D840,663 S 2/2019 Flanagan et al.
D854,303 S 7/2019 Flanagan et al.
10,455,898 B1 10/2019 Orand et al.
10,617,174 B1 4/2020 Hopkins et al.
10,638,810 B1 5/2020 Cheney et al.
10,905,192 B1 2/2021 Cheney
11,191,321 B2 12/2021 Kilgore et al.
11,219,274 B2 1/2022 Orand et al.
11,344,077 B2 5/2022 Hopkins et al.
2002/0053147 A1 5/2002 Borsoi et al.
2002/0066213 A1 6/2002 Wells
2002/0092205 A1 7/2002 Hall et al.
2002/0112376 A1 8/2002 Tomat
2002/0144434 A1 10/2002 Farys et al.
2004/0088890 A1 5/2004 Matis et al.
2004/0111921 A1 6/2004 Lenormand
2004/0244226 A1 12/2004 Farys et al.
2005/0039348 A1 2/2005 Raluy et al.
2005/0081404 A1 4/2005 Hurd et al.
2005/0193592 A1 9/2005 Dua et al.
2005/0198869 A1 9/2005 Bouche et al.
2005/0210706 A1 * 9/2005 Johnson ..... A43C 11/16 36/50.1
2006/0010718 A1 1/2006 Auger et al.
2006/0032091 A1 2/2006 Kilgore
2007/0074425 A1 4/2007 Leong
2007/0256332 A1 11/2007 Calderone
2008/0083138 A1 4/2008 Lacorazza et al.
2008/0086911 A1 4/2008 Abbe
2008/0120871 A1 5/2008 Sato et al.
2008/0155788 A1 7/2008 Wilcox
2008/0307673 A1 12/2008 Johnson
2009/0100712 A1 4/2009 Baker et al.
2011/0016751 A1 1/2011 Somerville
2011/0078922 A1 4/2011 Cavaliere et al.
2011/0119959 A1 5/2011 Bodner
2011/0146106 A1 6/2011 Kaufman
2011/0185592 A1 8/2011 Nishiwaki et al.
2011/0308109 A1 12/2011 Sokolowski
2012/0079742 A1 4/2012 Ferreira et al.
2012/0180338 A1 7/2012 Lin
2012/0192453 A1 8/2012 Raysse et al.
2012/0198721 A1 8/2012 Cavaliere
2012/0297643 A1 11/2012 Shaffer et al.
2012/0304491 A1 12/2012 Kimura et al.
2012/0317839 A1 12/2012 Pratt
2013/0185959 A1 7/2013 Coleman
2013/0219747 A1 8/2013 Lederer
2013/0247416 A1 9/2013 Nurse et al.
2014/0130376 A1 5/2014 Fahmi et al.
2014/0137434 A1 5/2014 Craig
2014/0150292 A1 6/2014 Podhajny et al.
2014/0173935 A1 6/2014 Sabbioni
2014/0202044 A1 7/2014 Adami et al.
2014/0305005 A1 10/2014 Yeh
2015/0089835 A1 4/2015 Hammerslag et al.
2015/0143720 A1 5/2015 Avar
2015/0237960 A1 8/2015 Mallen et al.

(56) References Cited

U.S. PATENT DOCUMENTS

| | | | |
|---|---|---|---|
| 2015/0305432 | A1 | 10/2015 | Wiens |
| 2016/0007687 | A1 | 1/2016 | Surace et al. |
| 2016/0029743 | A1 | 2/2016 | Cavaliere et al. |
| 2016/0088899 | A1 | 3/2016 | Liles et al. |
| 2016/0113356 | A1* | 4/2016 | Clough ..... A41B 11/00 36/71.5 |
| 2016/0302530 | A1 | 10/2016 | Smith et al. |
| 2016/0324269 | A1 | 11/2016 | Dombrow et al. |
| 2016/0332063 | A1 | 11/2016 | Van Horne |
| 2016/0374427 | A1 | 12/2016 | Zahabian |
| 2017/0055630 | A1 | 3/2017 | Marshall |
| 2017/0099908 | A1 | 4/2017 | Lee et al. |
| 2017/0105485 | A1 | 4/2017 | Schenone et al. |
| 2017/0231319 | A1 | 8/2017 | Bohnsack et al. |
| 2017/0303632 | A1 | 10/2017 | Pratt et al. |
| 2017/0360143 | A1 | 12/2017 | Pratt et al. |
| 2017/0360151 | A1 | 12/2017 | Pratt |
| 2017/0370027 | A1 | 12/2017 | Da Costa Pereira Machado et al. |
| 2018/0098601 | A1 | 4/2018 | Hartenstein et al. |
| 2018/0110287 | A1 | 4/2018 | Hopkins et al. |
| 2018/0110292 | A1 | 4/2018 | Beers et al. |
| 2018/0206588 | A1 | 7/2018 | Pratt et al. |
| 2018/0213882 | A1 | 8/2018 | Morse |
| 2018/0279721 | A1 | 10/2018 | Doenges |
| 2018/0289109 | A1 | 10/2018 | Beers et al. |
| 2018/0338583 | A1 | 11/2018 | Sullivan |
| 2019/0045884 | A1 | 2/2019 | Uda et al. |
| 2019/0297999 | A1 | 10/2019 | Nakaya et al. |
| 2020/0000178 | A1 | 1/2020 | Pratt et al. |
| 2020/0196703 | A1 | 6/2020 | Hopkins |
| 2020/0196709 | A1 | 6/2020 | Orand et al. |
| 2020/0205511 | A1 | 7/2020 | Hopkins et al. |
| 2020/0205518 | A1 | 7/2020 | Hopkins et al. |
| 2020/0205520 | A1 | 7/2020 | Kilgore |
| 2020/0229536 | A1 | 7/2020 | Hopkins et al. |
| 2020/0253333 | A1 | 8/2020 | Kilgore et al. |
| 2020/0297076 | A1 | 9/2020 | Kilgore |
| 2020/0390183 | A1 | 12/2020 | Arnold |
| 2021/0068494 | A1 | 3/2021 | Zahabian |
| 2021/0106094 | A1 | 4/2021 | Cheney |
| 2021/0112914 | A1 | 4/2021 | Cheney |
| 2021/0112916 | A1 | 4/2021 | Schulten |
| 2021/0204643 | A1 | 7/2021 | Kyle |
| 2021/0204644 | A1 | 7/2021 | Kyle |
| 2021/0378356 | A1 | 12/2021 | Cheney et al. |
| 2023/0165339 | A1 | 6/2023 | Hopkins et al. |

FOREIGN PATENT DOCUMENTS

| | | | |
|---|---|---|---|
| CN | 1403041 | A | 3/2003 |
| CN | 1832693 | A | 9/2006 |
| CN | 1993064 | A | 7/2007 |
| CN | 101022744 | A | 8/2007 |
| CN | 201005111 | Y | 1/2008 |
| CN | 101480282 | A | 7/2009 |
| CN | 101991227 | A | 3/2011 |
| CN | 101991227 | B | 8/2012 |
| CN | 102762121 | A | 10/2012 |
| CN | 103313622 | A | 9/2013 |
| CN | 104203024 | A | 12/2014 |
| CN | 204317632 | U | 5/2015 |
| CN | 105163616 | A | 12/2015 |
| CN | 105611851 | A | 5/2016 |
| CN | 205568021 | U | 9/2016 |
| CN | 108697196 | A | 10/2018 |
| DE | 3928625 | A1 | 3/1991 |
| DE | 19534249 | A1 | 3/1997 |
| DE | 19611797 | A1 | 10/1997 |
| DE | 29809404 | | 8/1998 |
| DE | 10247163 | A1 | 4/2004 |
| DE | 102004005288 | A1 | 8/2005 |
| EP | 0149362 | A2 | 7/1985 |
| EP | 1059044 | A1 | 12/2000 |
| EP | 2319344 | A1 | 5/2011 |
| EP | 2438826 | A1 | 4/2012 |
| FR | 1083503 | A | 1/1955 |
| FR | 1474203 | A | 3/1967 |
| GB | 503525 | A | 4/1939 |
| GB | 2517148 | A | 2/2015 |
| GB | 2517399 | A | 2/2015 |
| JP | 50-11740 | U | 2/1975 |
| JP | 56-158803 | U | 11/1981 |
| JP | 57-72603 | A | 5/1982 |
| JP | 1-80010 | U | 5/1989 |
| JP | 1-81910 | U | 6/1989 |
| JP | 1181910 | A | 7/1989 |
| JP | 1-179511 | U | 12/1989 |
| JP | 2000-139502 | A | 5/2000 |
| JP | 2000-184902 | A | 7/2000 |
| JP | 2001-149394 | A | 6/2001 |
| JP | 2005-046520 | A | 2/2005 |
| JP | 2005-532115 | A | 10/2005 |
| JP | 2006-055571 | A | 3/2006 |
| JP | 2012-061046 | A | 3/2012 |
| JP | 2012-110687 | A | 6/2012 |
| KR | 20090130804 | A | 12/2009 |
| NL | 2000762 | C1 | 1/2009 |
| TW | 200743450 | A | 12/2007 |
| WO | 90/00358 | A1 | 1/1990 |
| WO | 2007080205 | A1 | 7/2007 |
| WO | 2009/154350 | A1 | 12/2009 |
| WO | 2010/059716 | A2 | 5/2010 |
| WO | 2015/183486 | A1 | 12/2015 |
| WO | 2016/002412 | A1 | 1/2016 |
| WO | 2017/090195 | A1 | 6/2017 |

OTHER PUBLICATIONS

Non-Final Office Action received for U.S. Appl. No. 17/750,193, dated Apr. 7, 2023, 8 pages.

Notice of Allowance received for U.S. Appl. No. 16/839,744, dated Apr. 5, 2023, 15 pages.

Notice of Allowance received for U.S. Appl. No. 17/950,781, dated Mar. 29, 2023, 7 pages.

Notice of Allowance received for U.S. Appl. No. 17/950,798, dated Mar. 27, 2023, 7 pages.

Office Action received for European Patent Application No. 19839789.5, dated Mar. 9, 2023, 5 pages.

Notice of Allowance received for U.S. Appl. No. 17/750,193, dated Jul. 19, 2023, 5 pages.

Notice of Allowance received for U.S. Appl. No. 17/950,814, dated Aug. 2, 2023, 5 pages.

Final Office Action received for U.S. Appl. No. 17/135,220, dated Jan. 25, 2023, 22 pages.

Notice of Allowance received for U.S. Appl. No. 17/482,809, dated Feb. 1, 2023, 5 pages.

Office Action received for European Patent Application No. 19842673.6, dated Feb. 7, 2023, 6 pages.

Office action received for European Patent Application No. 19839789.5, dated Sep. 6, 2022, 8 pages.

Partial European Search Report received for European Application No. 22191953.3, dated Sep. 29, 2022, 11 pages.

Extended European Search Report received for European Patent Application No. 23159696.6, dated May 25, 2023, 13 pages.

Intention to Grant received for European Patent Application No. 19842673.6, dated Jun. 9, 2023, 7 pages.

Nike Lunarglide 7 Review, Solereview Inc., Available online at <https://www.solereview.com/nike-lunarglide-7-review/>, Nov. 8, 2015, 40 pages.

Non-Final Office Action received for U.S. Appl. No. 17/950,781, dated May 16, 2023, 5 pages.

Non-Final Office Action received for U.S. Appl. No. 17/950,857, dated Jun. 20, 2023, 13 pages.

Final Office Action received for U.S. Appl. No. 16/839,744, dated Dec. 9, 2022, 18 pages.

Intention to Grant received for European Patent Application No. 19836920.9, dated Oct. 28, 2022, 6 pages.

Non-Final Office Action received for U.S. Appl. No. 17/482,809, dated Nov. 22, 2022, 5 pages.

(56) References Cited

OTHER PUBLICATIONS

Non-Final Office Action received for U.S. Appl. No. 17/135,220, dated Aug. 18, 2023, 25 pages.
Intention to Grant received for European Patent Application No. 19839786.1, dated Oct. 12, 2023, 7 pages.
Extended European Search Report received for European Application No. 22191953.3, dated Jan. 9, 2023, 10 pages.
Non-Final Office Action received for U.S. Appl. No. 17/950,814, dated Dec. 27, 2022, 10 pages.
Non-Final Office Action received for U.S. Appl. No. 17/950,798, dated Dec. 16, 2022, 8 pages.
Non-Final Office Action received for U.S. Appl. No. 17/950,781, dated Dec. 14, 2022, 9 Pages.
Intention to Grant received for European Patent Application No. 19839789.5, dated Aug. 16, 2023, 7 pages.
Office Action received for European Patent Application No. 19842672.8, dated Sep. 27, 2023, 5 pages.
Final Office Action received for U.S. Appl. No. 17/950,857, dated Nov. 9, 2023, 23 pages.
Anonymous, "Two Piece Snap Rivets", ITW Fastex, Plastic Fasteners Catalog, Retrieved from the Internet: <http://www.itw-fastex.com/catalog/index.php/dw/op/a/6/c/14/p/27?m=no#/specs>, Jan. 30, 2008, pp. 1-2.

* cited by examiner

HEEL STRUCTURE WITH LOCATING PEGS AND METHOD OF MANUFACTURING AN ARTICLE OF FOOTWEAR

CROSS REFERENCE TO RELATED APPLICATIONS

This application is a continuation of U.S. application Ser. No. 16/894,266 (filed Jun. 5, 2020), which is a divisional of U.S. application Ser. No. 16/235,377 (filed Dec. 28, 2018), which are incorporated herein by reference in their entireties.

TECHNICAL FIELD

The present disclosure generally includes an article of footwear, a method of manufacturing an article of footwear, and a heel structure for an article of footwear.

BACKGROUND

Traditionally, placing footwear on a foot often requires the use of one or both hands to stretch the ankle opening of a footwear upper, and hold the rear portion during foot insertion, especially in the case of a relatively soft upper and/or footwear that does not have a heel counter.

BRIEF DESCRIPTION OF THE DRAWINGS

The drawings described herein are for illustrative purposes only, are schematic in nature, and are intended to be exemplary rather than to limit the scope of the disclosure.

DETAILED DESCRIPTION

Figure 1:
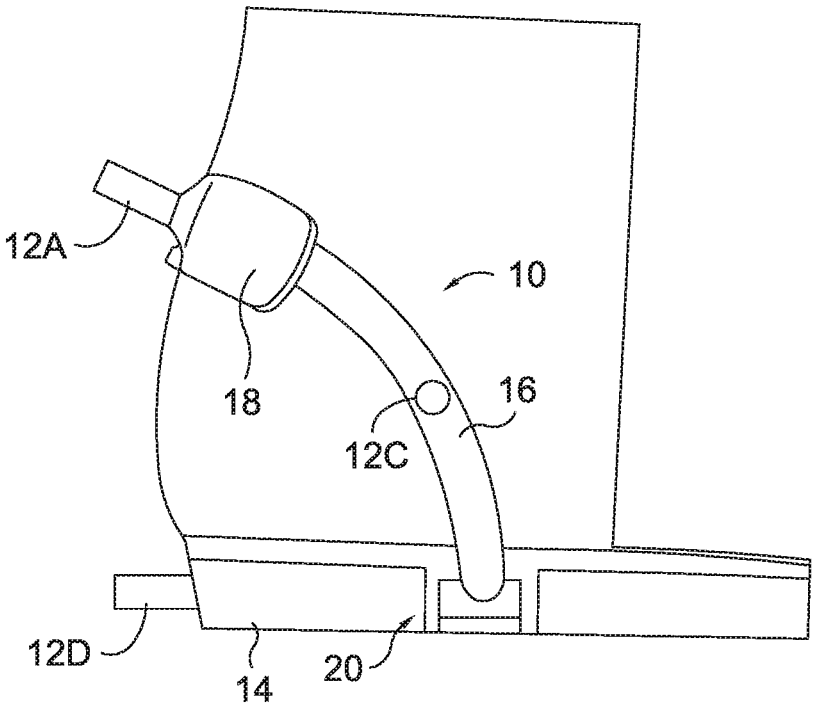
FIG. 1 is a side view of a heel structure.

In an example, an article of footwear may comprise an upper including an inner layer and an outer layer, and defining a foot-receiving cavity inward of the inner layer. The outer layer defines at least one aperture. A heel structure is provided and has a deformable element attached to a rigid base. The deformable element is capable of movement between an uncollapsed and a collapsed configuration with respect to the base. The deformable element is also disposed between the inner layer and the outer layer and the inner layer is disposed between the deformable element and the foot-receiving cavity. At least one peg is provided and extends outward from at least one of the deformable element, and the base, and extends through the aperture in the outer layer. The peg is secured at a surface of the upper.

In one or more implementations, the upper outer layer may include a plurality of apertures and the deformable element may include a medial portion, a lateral portion, and a heel piece. A first peg may extend outward from the heel piece and may be positioned in a respective aperture in the outer layer. A second peg may extend outward from the medial portion and may be positioned in a respective aperture in the outer layer. A third peg may extend outward from the lateral portion and may be positioned in a respective aperture in the outer layer. Still further, each of the pegs can be secured at a surface of the upper.

In still further implementations, each of the pegs may include a shaft portion and a head portion of unitary, integral construction with the shaft portion. The shaft portion may extend through one of the apertures of the upper and the head portion may be bonded at the surface of the upper.

In an aspect, the head portion may depict at least one of a number, a letter, a symbol, a logo, an object, or a design, or may have a specific surface texture, or may be a specific color. Additionally, the pegs need not be the same, as one or more of the pegs may depict a different number, letter, symbol, logo, object, design, surface texture, or specific color than one or more of the other pegs.

In a further aspect, a peg may extend outward from a peripheral portion of the rigid base.

In an additional configuration, the deformable element may be disposed between the outer layer and the inner layer prior to the attachment of the deformable element to the base.

In a still further configuration, the base may include an anchor receptacle located on the medial side of the base and another anchor receptacle located on the lateral side of the base. Each of the anchor receptacles may include at least one pin. The deformable element may include an anchor located on the medial side of the element and an anchor located on the lateral side of the element. Each of the anchors may include at least one aperture for receiving a respective pin of the anchor receptacle.

In yet another configuration, the deformable element may be disposed between the outer layer and the inner layer after the attachment of the deformable element to the base.

In a further example, the outer layer may include a plurality of tabs extending from a lower edge of the outer layer and the tabs may be used to secure the upper to the rigid base.

In a further example, a method of manufacturing may be provided including placing a deformable element between an inner layer of an upper and an outer layer of the upper. The deformable element may include at least one peg extending outward toward the outer layer. The method may include inserting the at least one peg of the deformable element through the outer layer of the upper so that the at least one peg extends through the outer layer and is exposed at an exterior surface of the outer layer. The method may include attaching the deformable element to a rigid base utilizing at least one aperture on the deformable element that receives at least one pin extending from the base. The method may provide securing the at least one peg at the exterior surface of the outer layer.

In further configurations, the at least one peg may include multiple pegs, and the outer layer of the upper may include multiple apertures. The pegs may be spaced apart from one another in a first arrangement. The apertures may be spaced apart from one another in the first arrangement so that the apertures align with the pegs.

In a further implementation, the at least one peg may be bonded to the exterior surface of the outer layer.

A further aspect includes pressing a heating tool against an end of the at least one peg at the exterior surface of the outer layer to melt the end against the exterior surface of the outer layer.

An additional configuration may provide a heating tool having a mold surface that shapes a head portion of the at least one peg at the exterior surface of the outer layer. The pressing of the heating tool to melt the end creates the head. The configuration may include selecting the heating tool from a group of heating tools each having a mold surface with a different shape depicting at least one of a number, a letter, a symbol, a logo, an object, or a design, or with a different surface texture.

In additional implementations, the heating tool is selected in response to a request for a specific shape or a specific surface texture of the head; and the mold surface of the heating tool selected has the specific shape or the specific surface texture requested.

A further aspect includes placing the deformable element between the inner layer of the upper and the outer layer of the upper through an opening between the inner layer and the outer layer and closing the opening.

A still further implementation includes using a heating element on a respective pin to enhance the attachment of the deformable element to the base.

A still further aspect includes the base having one or more pegs extending from a periphery of the base and extending through the outer layer.

In an additional implementation, the pegs and the apertures are used to provide an initial bias to the deformable member when the deformable member is in an uncollapsed position.

In a still further configuration, the outer layer includes a plurality of tabs extending from a lower edge and the tabs are used to secure the base to the upper.

The above features and advantages and other features and advantages of the present teachings are readily apparent from the following detailed description of the modes for carrying out the present teachings when taken in connection with the accompanying drawings.

Figure 2:
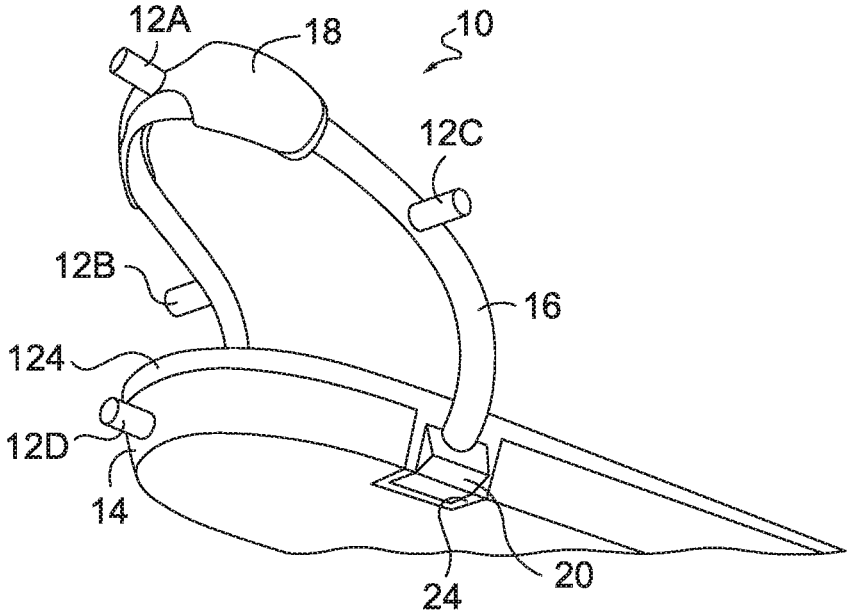
FIG. 2 is a rear perspective view of the heel structure.
Figure 3:
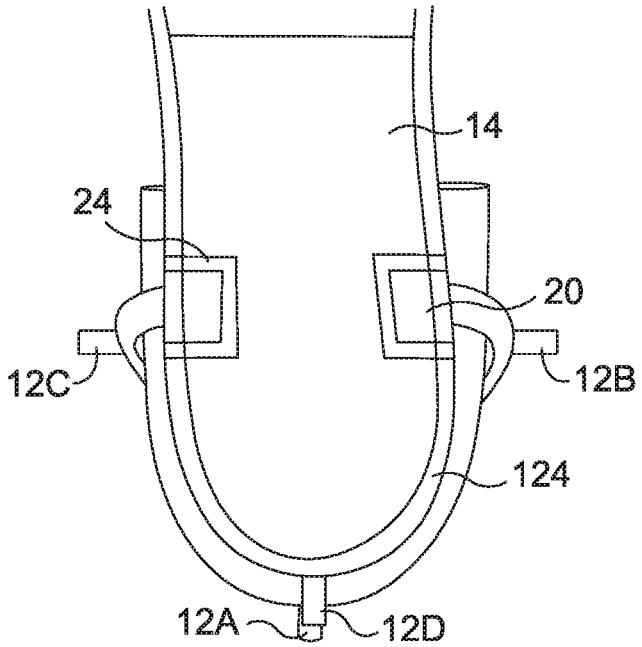
FIG. 3 is a bottom plan view of the heel structure.

Referring to the drawings, wherein like reference numbers refer to like components, FIGS. 1-3 shows a heel structure 10 that is a deformable structural member of an article of footwear. The heel structure 10 is an improvement over the heel structure described in U.S. Pat. No. 9,820,527 which is hereby incorporated herein by reference. The heel structure 10 eases foot entry into an article of footwear as described herein. The improvement over the structure disclosed in U.S. Pat. No. 9,820,527 includes pegs 12 that serve as locating features for accurately positioning the heel structure 10 relative to an upper during manufacturing, as described herein. In the embodiment shown, there are four pegs 12, only three of which are visible in FIG. 1. It is anticipated that there can be any number of pegs 12 positioned along any portion of the heel structure 10.

For the sake of completeness and clarity, turning first to a description from U.S. Pat. No. 9,820,527 about certain elements and their operation that are in common with the current embodiments hereof (with continued reference to FIGS. 1-3) the heel structure 10 comprises at least one base 14 and at least one deformable element 16. The deformable element 16 is coupled to the base 14 and is generally embedded within and/or is coupled to and extends along the rear portion of a shoe in which the heel structure 10 is positioned. While a single deformable element 16 may extend continuously about the rear portion of the shoe, the heel structure 10 may include a heel piece 18 positioned between two separate and distinct deformable elements 16, according to various embodiments described below. As used herein, the term "deformable element" refers to a resiliently flexible member that can be bent or compressed but has a bias to move towards a non-bent or uncompressed state. Additional details pertaining to the deformable element 16 are included below.

The deformable element(s) 16 is/are coupled to the base 14, according to various embodiments. The term "base" may refer to a rigid portion or section of the shoe to which the deformable element(s) 16 is/are coupled. The base 14 refers to an anchoring connection point(s) to which the deformable element(s) 16 is/are coupled. The base 14 may refer to an outsole or portions thereof, a midsole or portions thereof, an insole or portions thereof, a wedge or portions thereof, the upper or portions thereof (e.g., a heel counter), or other suitable structure disposed between and/or adjacent to these listed parts of a shoe.

While in various embodiments the deformable element 16 is directly coupled, mounted, or attached to the base 14, in other embodiments the base 14 may optionally include one or more anchors 20. In various embodiments, the anchor 20 may be a portion of the base 14 that engages and retains the deformable element(s) 16 in place. In various embodiments, the anchor(s) 20 can be integrally formed with, coupled to and/or located within or between, or outside of an insole, midsole, outsole, upper, or other rear portion shoe in which the heel structure is positioned.

Figure 8:
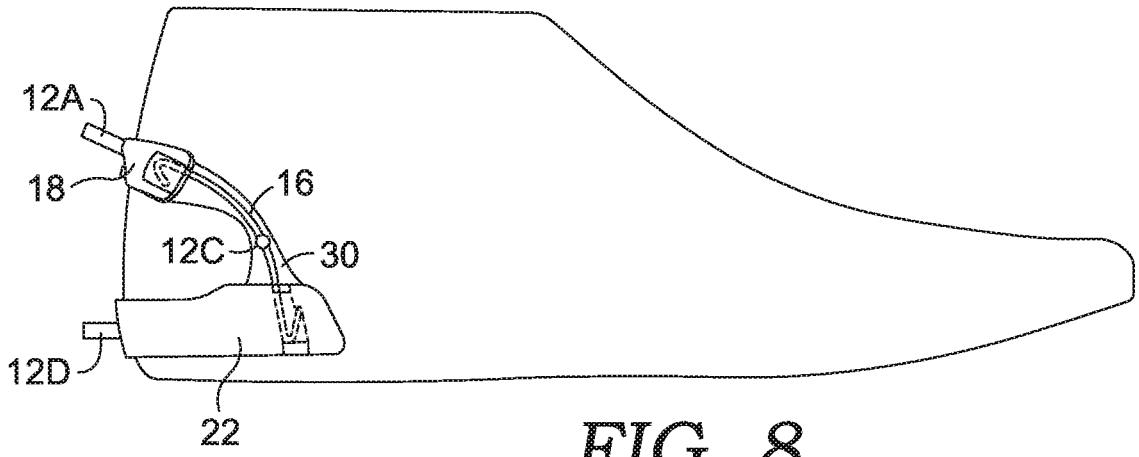
FIG. 8 is a side view of a heel structure with a heel counter.

In various embodiments, for example, the anchor 20 is disposed in a block or a wedge. The anchor 20 can be located in the upper, in the heel counter 22 (with reference to FIG. 8) or other device located above the outsole. Anchor 20 also can be located between the midsole and the outsole, between the footbed and the midsole, and/or outside the upper. In an embodiment, the midsole can be carved or cut out to attach or house anchor 20 to the shoe. Anchor 20 may also be attached to or in the heel counter 22. FIG. 8 illustrates a wire anchored in a heel counter 22 where the heel counter 22 is shaped to allow collapse of the heel in accordance with an example embodiment of the present disclosure. In various embodiments, the base 14 of heel structure 10 can include a single anchor 20 extending the full width of a shoe or the base 14 may include two anchors 20 on opposing sides (e.g., lateral and medial) of the shoe.

Anchor 20 is generally a structure provided to secure deformable elements 16 and/or heel pieces 18 to a shoe. For example, and with reference to FIGS. 1-3, the base 14 may include an anchor 20 and an anchor receptacle 24.

Deformable element 16, as briefly introduced above, is generally a structure provided to return heel structure 10 from a collapsed configuration to an uncollapsed configuration. Heel structure 10 can include one or more deformable elements 16, for example, one on either side of a shoe. As an example, a single deformable element 16 can travel from one side of a shoe to the other side of shoe and can be attached to one or more anchors 20.

Deformable element 16 can include one or more of a tube, a wire, a spring, a shape memory structure or material, and the like. In example embodiments, deformable element 16 includes a single, unitary piece. For instance, and according to various embodiments, a first end of deformable element 16 can be embedded in or attached to a left anchor 20 (or the left side of a unitary anchor 20), a second end of deformable element 16 can be embedded in or attached to a right anchor 20 (or the right side of a unitary anchor 20), and a middle portion of deformable element 16 can extend around the heel (or be coupled to or be embedded within a heel piece 18), according to various embodiments.

In various embodiments, the first and second ends of the deformable element 16 are disposed below the footbed of a shoe. The connection locations (e.g., anchors 20) of the base 14, to which the deformable element 16 is connected, are positioned below the footbed of the shoe. In various embodiments, the heel structure 10 may be configured so a rear portion of a shoe upper remains positioned above the footbed of the shoe at all times. Said differently, regardless of whether the heel structure 10 is in a collapsed configuration or an uncollapsed configuration, a rear portion of an upper may remain above the footbed of the shoe, according to various embodiments.

Figure 4:
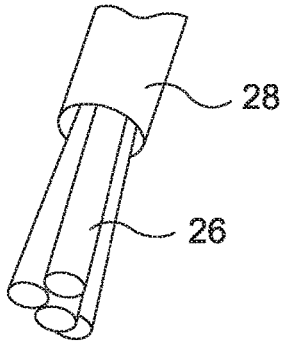
FIG. 4 is a partial perspective view of a deformable element, parts broken away to reveal details of construction.

In other embodiments, deformable element 16 includes a plurality of separate and distinct components. For instance, deformable element 16 can include two separate components, with a first component having a first end embedded in or attached to a left anchor 20 (or the left side of a unitary anchor 20) and a second end embedded in or attached to the left side of heel piece 18 (or a left paddle 19 of heel piece 18), and with a second component having a first end embedded in or attached to a right anchor 20 (or the right side of a unitary anchor 20) and a second end embedded in or attached to the right side of heel piece 18 (or a right paddle 19 of heel piece 18). The plurality of separate and distinct components can be secured together, for example, with one or more of a tape wrap, woven encasing, overmold (e.g., TPU), heat shrink tube, and the like, each of which can provide different stabilities and strengths. By way of non-limiting example, and with reference to FIG. 4, deformable element 16 can include one or more wires 26 encased or encased together in a cover, sleeve, overmold, or heat shrink tube 28. The one or more wires 26 can arch, bend, and sway and then return to its initial/normal state.

Deformable element 16 can have variable mechanical properties along its length and/or at distinct points along its length. Such variation can be provided by deformable element 16, one or more of its plurality of separate and distinct components, and/or a securement surrounding all or a portion of deformable element(s) 16, having a variable cross-section, density, material, and/or the like along its length. A variable cross-section, in turn, can be provided by variation in thickness or shape, or twisting of deformable element 16 otherwise having a constant thickness or shape along its length. In various embodiments, the plurality of deformable elements 16 can comprise the same or different mechanical properties, for example, they can flex independent of each other.

In various embodiments, and with reference to FIG. 8, the deformable element 16 includes a cover, sleeve, overmold, or other suitable structure (schematically shown as element 30). This cover 30 can protect the deformable element 16 and may control, guide, support and/or otherwise affect the flexure or compression of the deformable element 16. In various embodiments, the cover 30, based on its material of manufacture, shape, geometry etc., is configured to facilitate mechanical stress distribution by transferring mechanical bending/deforming forces from the deformable element 16 to the cover 30 to prevent or at least inhibit the deformable element from damage or breakage that may otherwise result from the concentrated and repeated mechanical stress experienced by the deformable element 16. For example, the cover 30 may have dimensions that vary along its length, such as the funnel-like tapering shape shown in FIG. 8, to help distribute stress and contribute to the dynamic flexing of the deformable element 16. In the rare event that the deformable element 16 breaks, the cover 30 may provide at least some degree of bias, thereby still enabling a certain level of rebound to help the shoe return to the uncollapsed position. Further, the cover may provide additional padding and/or support to the deformable element and may prevent or at least inhibit the user from feeling the deformable element extending around the heel.

Deformable element 16 can further have directional biases. Such biases can be provided as described above, by deformable element 16, one or more of its plurality of separate and distinct components, and/or a securement surrounding all or a portion of deformable element(s) 16, having a variable cross-section, density, material, and/or the like along its length. By way of non-limiting example, deformable element 16 can include a first component or wire (e.g., nitinol) that is sufficiently resiliently flexible to return heel structure 10 from a collapsed configuration to an uncollapsed configuration, and can further include a second component or wire (e.g., graphite) that directs one or more desired arc(s) of curvature of deformable element 16 (e.g., an arc viewed from a side of a shoe, and an arc viewed from an end of a shoe). These two components can be covered or encased with a plastic coating or shield, as described above, as will be described in greater detail below with reference to FIG. 8. The heel structure 10 can be collapsed by a user's foot depressing down on it from the sides or the rear heel of a shoe. The heel structure 10 can be depressed off-center (e.g., from the sides) and still work and rebound properly.

Figure 5:
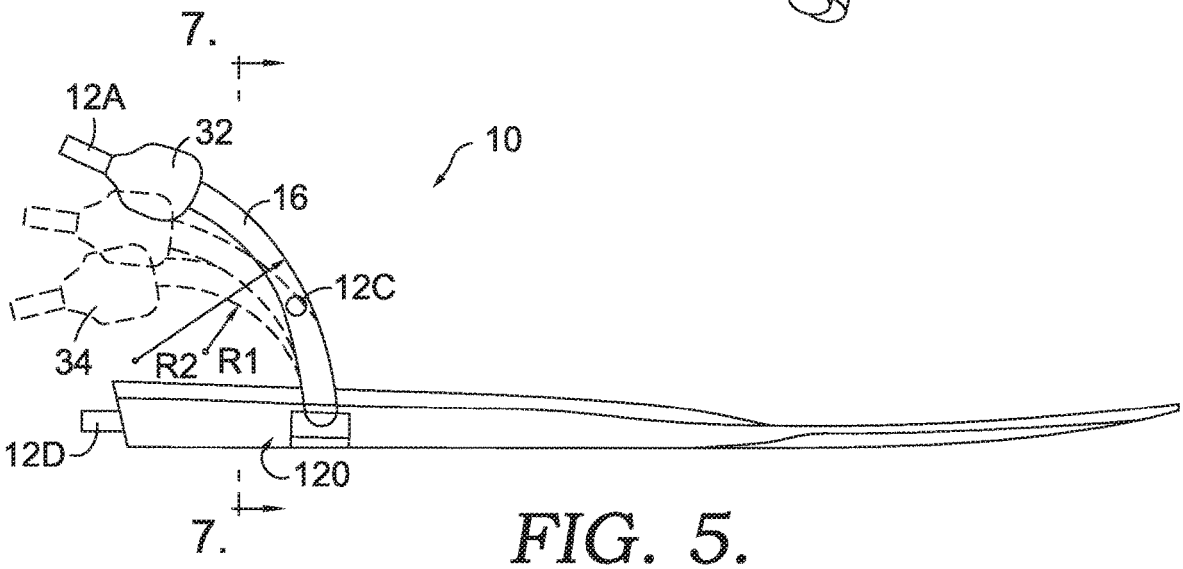
FIG. 5 is a side view of the heel structure under loading.
Figure 6:
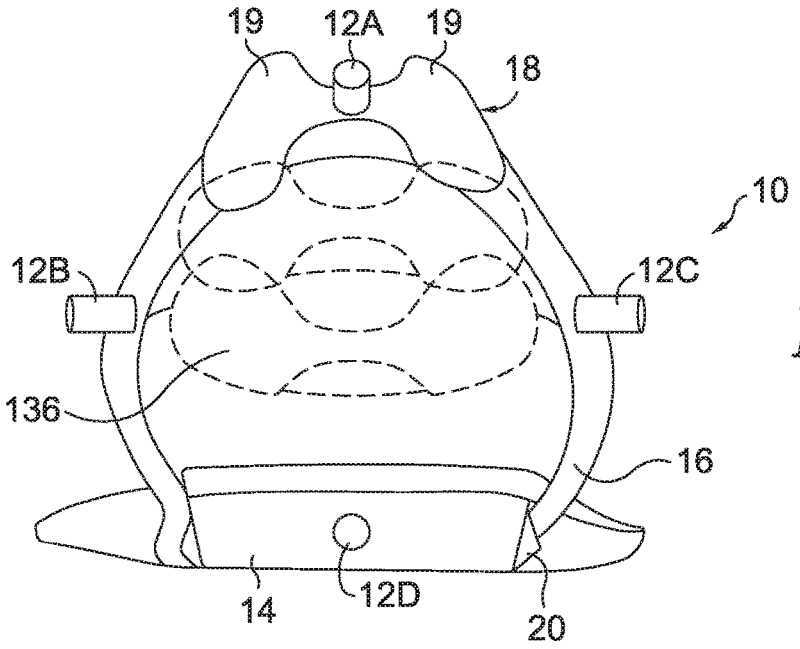
FIG. 6 is a rear view of the heel structure under loading.

With reference to FIGS. 5 and 6, deformable element 16 can exhibit one or more desired arc(s) of curvature as heel structure 10 moves between an uncollapsed configuration 32 and a collapsed configuration 34. For example, deformable element 16 can comprise a first arc of curvature viewed from a side of a shoe (FIG. 5), and a second arc of curvature viewed from an end of a shoe (FIG. 6). In this regard, deformable element 16 is not planar in some embodiments.

An arc of curvature can originate from anchor 20, however, in example embodiments, deformable element 16 does not pivot (i.e., is non-pivoting) about the base 14 (e.g., about an insole, midsole, or outsole) of the shoe. The deformable element 16 may be non-rotatably coupled to the base 14. In various embodiments, engagement between the deformable element 16 and the base 14 (or anchor receptacle 24) is free of play, meaning that there is little or no relative movement between the two components 16, 14.

In some embodiments, an arc of curvature is constant along its length, while in other embodiments, an arc varies along its length and/or at distinct points along its length, for example, by exhibiting variable mechanical properties, as described above. In some embodiments, variation between an uncollapsed configuration and a collapsed configuration may be due to the constraints of the upper construction of the shoe.

With particular reference to FIG. 5, an arc of curvature viewed from a side of a shoe exhibited by deformable element 16 can have a first radius of curvature R1 when heel structure 10 is in a collapsed configuration, and a second radius of curvature R2 (that is greater than first radius of curvature R1) when heel structure 10 is in an uncollapsed configuration. In example embodiments, first radius of curvature R1 is about 30% to about 60% smaller, or about 45% smaller than second radius of curvature R2.

Deformable element 16 can include one or more materials such as carbon steel, stainless steel, titanium, nickel titanium (nitinol) and other metals and alloys (shape memory or otherwise), polymers (shape-memory or otherwise), composite materials, foam materials, graphite, carbon fiber, fiberglass, TPC-ET, silicone, TPU, and polycarbonate. For example, deformable element 16 can include titanium or be a titanium wire. Also, one or more deformable elements 16 can be made of a first material, e.g., titanium, and one or more deformable elements 16 can be made of a second material, e.g., graphite, which advantageously allow easier deformation of heel structure 10 while at the same time providing faster rebounding of heel structure 10 to its original position (i.e., the uncollapsed configuration).

Figure 7:
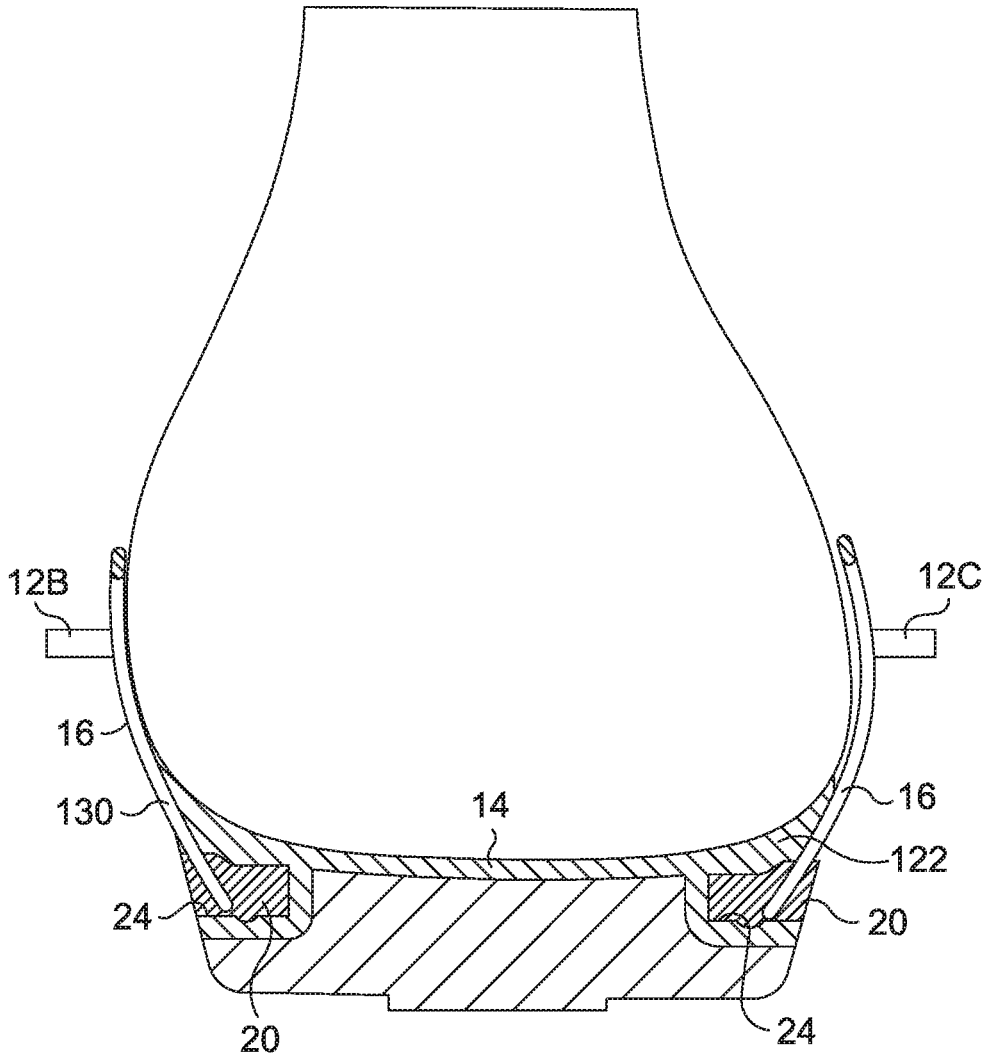
FIG. 7 is a partial cross-sectional view of the heel structure taken at lines 7-7 of FIG. 5.

In various embodiments, and with reference to FIG. 7, the ends of the deformable element 16 that are mounted to the base 14 are oriented outwards at an angle relative to a vertical axis extending through the base 14. This angled orientation allows the deformable element 16 to extend around and/or follow the contours of the heel of the foot of the user, according to various embodiments. The deformable element can be configured to follow natural contours of a user's foot/heel in the uncollapsed configuration and/or in the collapsed configuration. Accordingly, in various embodiments, the flexure, curvature, and/or length of the deformable element 16 on one side of the foot (e.g., medial side) may be different than the curvature and/or length of the deformable element 16 on the other side of the foot (e.g., lateral side).

At least a portion of the deformable element 16 may be connected to the rear portion of the shoe. For example, the deformable element 16 may be coupled to the shoe in proximity to the top line of the shoe opening so that the rear portion of the shoe collapses in response to the heel structure 10 changing to the collapsed configuration and the rear portion of the shoe rebounds in response to the heel structure 10 reverting back to the uncollapsed configuration. In various embodiments, portions of the deformable element 16 may move within the rear portion (e.g., the quarter) of the shoe. For example, the deformable element 16 may be disposed between an inner surface and an outer surface of the quarter or heel counter of the shoe and, in response to deformation of the deformable element 16, may move relative to the inner and outer surfaces of the shoe. In example embodiments, the deformable element 16 or heel piece 18 can be completely contained within the rear portion of the shoe. While the deformable element 16 is visible by a user in some embodiments, in other embodiments, the deformable element 16 is not visible by a user.

In various embodiments, and with reference to FIG. 5, the deformable element 16 extends from the base 14 in an upwards and backwards (i.e., towards the rear portion of the shoe) direction. This extension direction of the deformable element 16, according to various embodiments, prevents or at least inhibits the deformable element 16 from folding substantially inwards relative to the shoe opening in response to insertion of a user's foot. While the deformable element 16 generally deforms and responds to a user's foot being inserted into the shoe, the deformable element 16 generally prevents the topline (e.g., collar topline of shoe opening) from folding or bending inwards (i.e., prevents the shoe opening from substantially collapsing). In various embodiments, however, the deformable element 16 allows the shape of the rear portion of the topline of the shoe opening to deform and contour to the shape of the user's foot.

Figure 9:
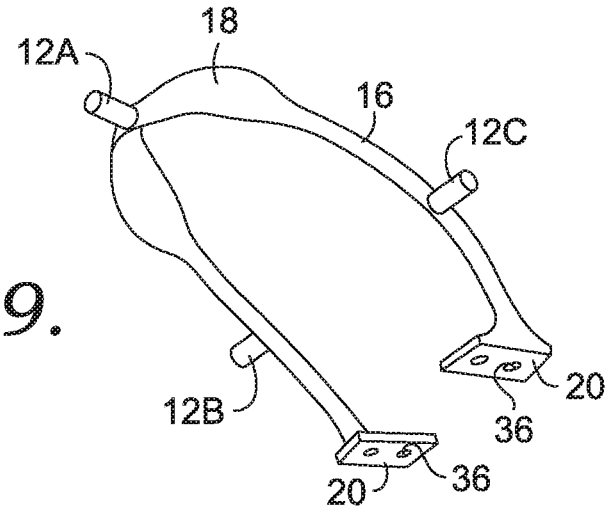
FIG. 9 is a rear perspective view of a deformable element of the heel structure.
Figure 10:
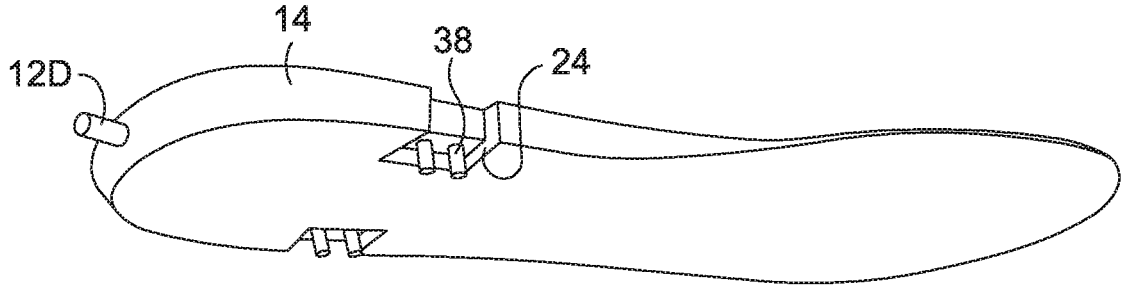
FIG. 10 is a rear perspective view of the base of the heel structure.
Figure 11:
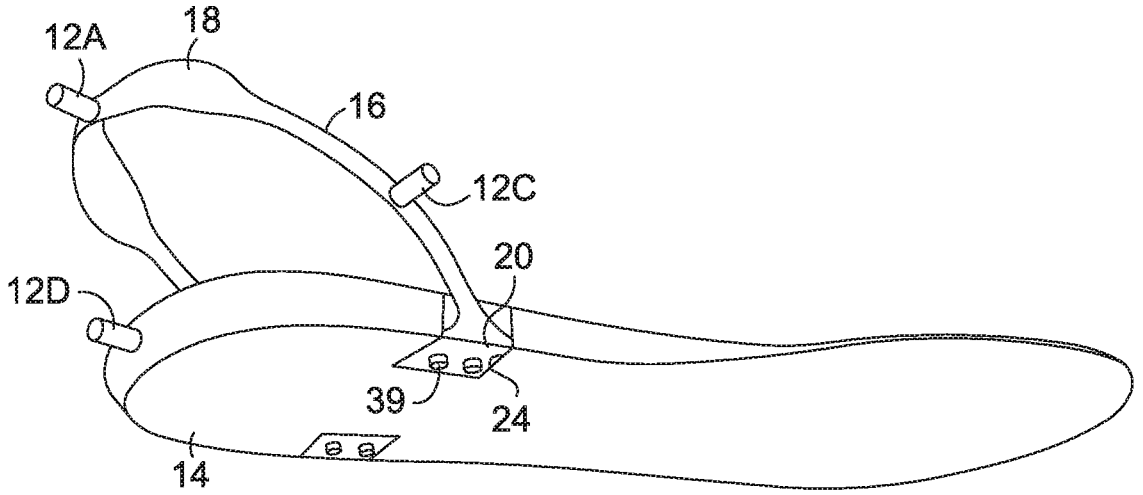
FIG. 11 is a rear perspective view of the deformable element and the base attached to one another.

In various embodiments, as mentioned above, the base 14 may include an anchor 20 and an anchor receptacle 24. The anchor 20 may be able to be installed/coupled to the anchor receptacle 24, for example, via a resistance fit, compression fit, a snap fit, or via an interlocking mechanism/configuration. In such embodiments, the deformable element 16 may be first coupled to the anchor 20 and then the anchor 20 may be installed/coupled to the anchor receptacle 24. Referring to FIGS. 9-11 an interlocking configuration is shown. The configuration includes a deformable element with anchors 20 having two apertures 36 formed therein. The base 14 can be of a rigid construction and has anchor receptacles 24 formed therein for receiving the anchors 20. Each of the anchor receptacles 24 includes a pair of pins 38 that are received in the apertures 36 of the anchors 20. The engagement of the anchor 20 in the anchor receptacle 24 and specifically the engagement of the pins 38 with the apertures 36 results in a snap fit that is used to secure the deformable element 16 to the base 14. The snap fit is a result of a friction fit between the edges of the anchors 20 and the edges of the anchor receptacles 24 and between the pins 38 and the apertures 36. As is apparent, although two pins are depicted in a respective anchor receptacle 24, any number of pins 38 and corresponding apertures 36 could be used.

Optional heel piece 18 is generally a structure provided to secure a rear portion of shoe about a user's heel when heel structure 10 is in an uncollapsed configuration, and direct a user's foot into, or otherwise accommodate a user's foot with respect to, a shoe opening when heel structure 10 is in a collapsed configuration. Heel structure 10 can include a plurality of heel pieces 18.

Turning now from the detailed description from U.S. Pat. No. 9,820,527, the improvement to the embodiments of U.S. Pat. No. 9,820,527 will now be described. The improvements include the provision of the pegs 12 along any number of the portions of the elements disclosed in U.S. Pat. No. 9,820,527.

The pegs 12 are spaced apart from one another in a first arrangement on the heel structure 10. The first arrangement is the relative spacing of the pegs 12 (e.g., the distances between the different pegs 12) as shown in FIGS. 1-3, when the device 10 is in the unloaded position. A first peg 12A can be integral with and extends outward from one of the heel piece 18 of the deformable element 16. A second peg 12B can be integral with and extends outward from the medial portion of the deformable element 16. The second peg 12B is shown extending outward from the medial side of the deformable element 16. A third peg 12C can be integral with and extends outward from the lateral portion of the deformable element. The third peg 12C is shown extending outward from the lateral side of the deformable element. In another embodiment, a fourth peg 12D extends outward from the back heel region of the base 14.

In FIGS. 1-3, the heel structure 10 is shown prior to final assembly in an article of footwear. At the stage shown prior to final assembly, the pegs 12 are generally straight, cylindrical shafts extending at a constant width to terminal ends. Although four pegs 12 are shown, the heel structure 10 may have fewer or more pegs. Additional pegs 12 can be place anywhere along the deformable element 16, the heel pieces 18, and/or the periphery of the base 14. For instance, there can be two pegs 12 placed on the heel piece 18, with one extending outwardly from each paddle 19 of the heel piece 18. Providing at least two spaced pegs 12 provides some ability to accurately position the heel structure 10 relative to a footwear upper during manufacturing. By providing four pegs 12, with one peg 12A on the heel piece 18, one peg 12D on the base 14, one peg 12B on the medial side of deformable element 16, and one peg 12C on the lateral side of the deformable element 16, the four pegs 12 are arranged in a first arrangement that is four spaced points not all of which are coplanar. This more accurately positions the heel structure 10 relative to the upper during manufacturing than would only two or three pegs.

The material of heads of the pegs 12, which may be the same material as the deformable element and/or the base, is selected to provide a melt temperature lower than a melt temperature of a footwear layer at which the heads of the pegs are disposed, or at least the head of one of the pegs is disposed, as discussed herein. Example materials for the pegs 12 include plastics (such as thermoplastics), composites, and nylon. Another example material for the pegs 12 is a polyether block amide such as PEBAX® available from Arkema, Inc. in King of Prussia, Pennsylvania USA. Another example material for the pegs 12 is a fiberglass reinforced polyamide. An example fiberglass reinforced polyamide is RISLAN® BZM 7 0 TL available from Arkema, Inc. in King of Prussia, Pennsylvania USA. Such a fiberglass reinforced polyamide may have a density of 1.07 grams per cubic centimeter under ISO 1183 test method, an instantaneous hardness of 75 on a Shore D scale under ISO 868 test method, a tensile modulus of 1800 MPa under ISO 527 test method (with samples conditioned 15 days at 23 degrees Celsius with 50% relative humidity), and a flexural modulus of 1500 MPa under ISO 178 test method (with samples conditioned 15 days at 23 degrees Celsius with 50% relative humidity). Another example material for the pegs 12 is Nylon 12 (with or without glass fiber), such as RTP 200F or RTP 201F available from RTP Company of Winona, Minnesota USA. Another example material for the pegs 12 is rigid thermoplastic polyurethane (with or without glass fiber), such as RTP 2300 or RTP 2301 available from RTP Company of Winona, Minnesota USA. Still another example material for the pegs 12 is Acetal (Polyoxymethylene (POM)) (with or without glass fiber), such as RTP 800 or RTP 801 available from RTP Company of Winona, Minnesota USA.

Figure 12:
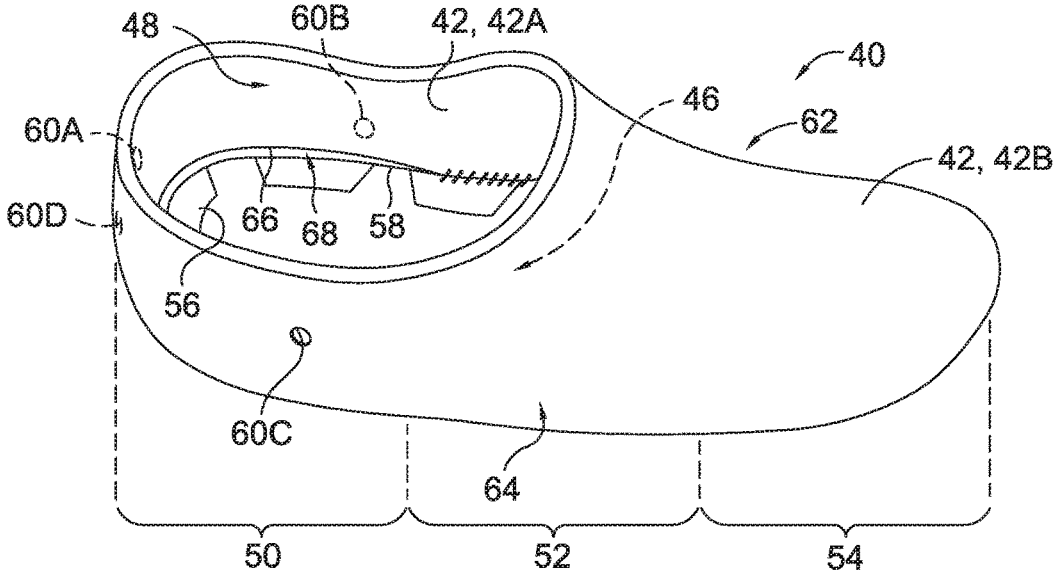
FIG. 12 is a lateral perspective view of an article of footwear showing an upper before insertion of the heel structure of FIG. 1.

FIG. 12 shows an upper 42 of an article of footwear 40 before the heel structure 10 is inserted into and secured to the upper 42. The footwear 40 herein is depicted as a leisure shoe or an athletic shoe, but the present teachings also include an article of footwear that is a dress shoe, a work shoe, a sandal, a slipper, a boot, or any other category of footwear.

The upper 42 includes an inner layer 42A and an outer layer 42B. The upper 42 defines a foot-receiving cavity 46 inward of the inner layer 42A, and an ankle opening 48 for access to the cavity 46. The inner layer 42A is disposed between the foot-receiving cavity 46 and the outer layer 42B (e.g., closer to a foot disposed within the foot-receiving cavity 46). The upper 42 may be a variety of materials or combination of materials, such as a 4-way stretch nylon fabric, a knit construction, or other material. The material of the upper 42 may be flexible to allow movement of the upper 42 with the heel structure 10 during easy access foot entry into the article of footwear 40 as described herein. The outer layer 42B may be referred to as a first layer of the upper 42, and is comprised of a first material having a first melt temperature and a first burn temperature.

Figure 16:
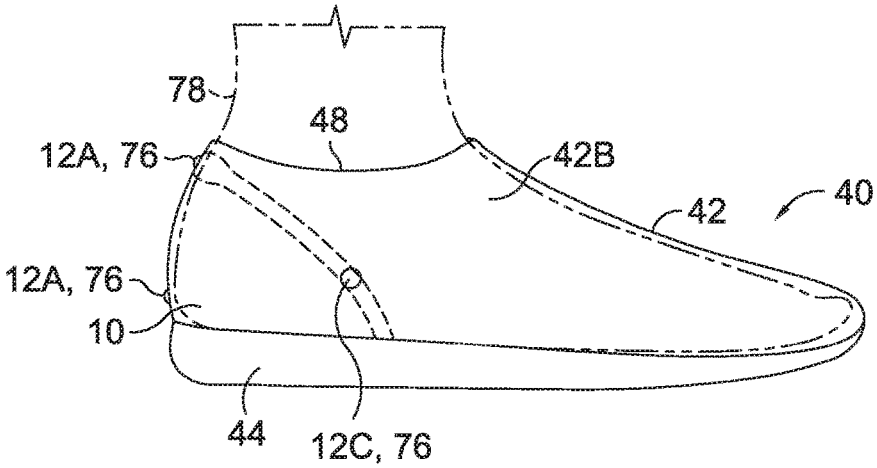
FIG. 16 is a lateral side view of the article of footwear with the foot fully inserted.

The article of footwear 40 includes a heel region 50, a midfoot region 52, and a forefoot region 54. With reference to FIGS. 12 and 16, the heel region 50 generally includes portions of the article of footwear 40 corresponding with rear portions of a human foot, including the calcaneus bone, when the human foot is supported on the sole structure 44 in the foot-receiving cavity 46 and is a size corresponding with the article of footwear 40. A forefoot region 54 of the article of footwear 40 generally includes portions of the article of footwear 40 corresponding with the toes and the joints connecting the metatarsals with the phalanges of the human foot (interchangeably referred to herein as the "metatarsophalangeal joints", "metatarsal-phalangeal joints", or "MPJ" joints). A midfoot region 52 of the article of footwear is disposed between the heel region 50 and the forefoot region 54 and generally includes portions of the article of footwear 40 corresponding with an arch area of the human foot, including the navicular joint.

The sole structure 44 includes one or more sole components that may be sole layers, such as an outsole, a midsole, or a unitary combination of an outsole and a midsole that may be referred to as a unisole. A lower portion of the footwear upper 42 may be secured to the sole structure 44, such as by adhesive or otherwise and/or may be stitched or otherwise secured to a strobel that is in turn secured to the sole layer. Still further, the outer layer 42B can include a plurality of attachment tabs 56 extending along a lower edge 58 of the outer layer 42B. These tabs 56 can be used to attach the upper 42 to the base 14 of the heel structure as will be more fully described below.

The outer layer 42B of the upper 42 has apertures 60A, 60B, 60C, and 60D arranged in the same first arrangement relative to one another as the pegs 12 of the deformable element 10 and the base 14 and can therefore serve as complementary locating features for the pegs 12. Aperture 60A is at a rear of the heel region 50, relatively high on the upper 42. Aperture 60B is at a medial side 62 of the article of footwear 40. Aperture 60C is at a lateral side 64 of the article of footwear 40. Aperture 60D is at the rear of the heel region 50, relatively low on the upper 42 such that it is closer to the sole structure 44 than aperture 60A, and generally vertically aligned with (e.g., falling directly below) aperture 60A. Apertures 60A and 60D can be spaced apart from one another with the same spacing (e.g., distance between the apertures 60A, 60D) as pegs 12A and 12D. Still further, the apertures 60A and 60D can be spaced in such a way that the apertures secure an initial bias within deformable element 16 when the deformable element 16 and base 14 are deployed in a footwear 40. The apertures 60B and 60C can be spaced apart from one another with the same spacing (e.g., distance between the apertures 60B, 60C) as pegs 12B, 12C. Apertures 60B and 60C can also be spaced apart from apertures 60A and 60D with the same spacing as pegs 12B and 12C are spaced relative to pegs 12A and 12D. The apertures 60A, 60B, 60C, and 60D extend through the outer layer 42B as through holes. The inner layer 42A need not have apertures for connection of the device 10 within the article of footwear 50. However, the inner layer can have apertures therein to match pegs that extend inwardly in accordance with an aspect hereof as will be more fully explained below.

As shown in FIG. 12, a lower edge 66 of the inner layer 42A is left unsecured in the heel region 50 at this stage in the manufacturing to create an opening 68 to allow insertion of the heel structure 10 between the inner layer 42A and the outer layer 42B. Forward of the heel region 50, the inner layer 42A may be sewn or otherwise secured to the sole structure 44, to a strobel, or to the outer layer 42B. The opening 68 extends from the medial side 62 around the rear of the heel region 50 to the lateral side 64.

Figure 13:
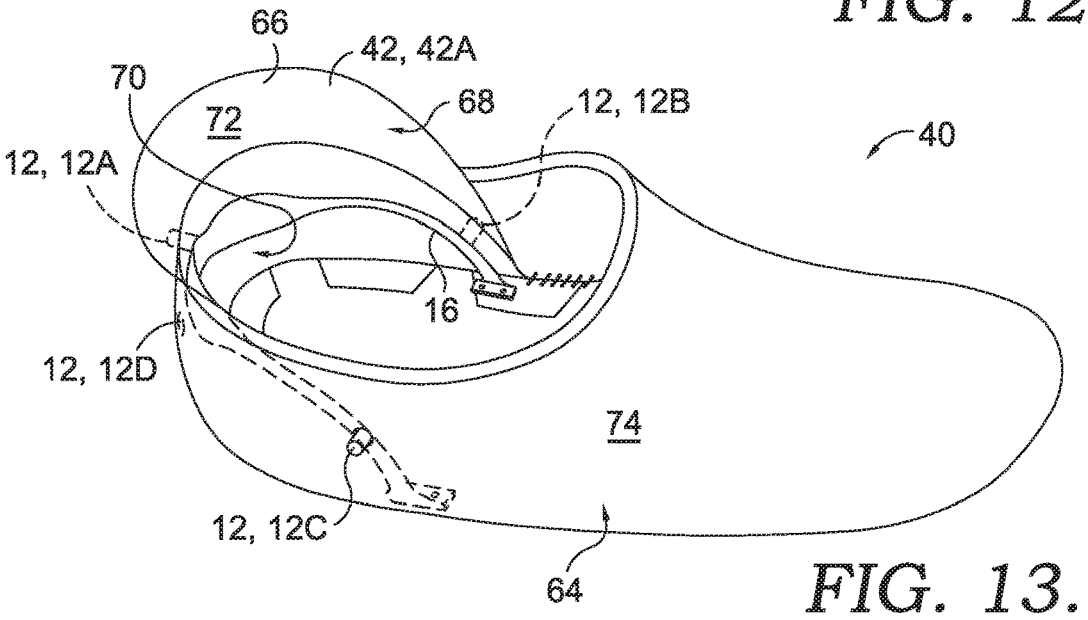
FIG. 13 is a lateral perspective view of the article of footwear showing the deformable element of the heel structure inserted through an opening between an inner layer and an outer layer of the upper with pegs extending through apertures in the outer layer.

As shown in FIG. 13, the inner layer 42A is a pliable material, such that it can be lifted at the lower edge 66 where it is unsecured to enlarge the opening 68, allowing the deformable element 16 of the heel structure 10 to fit through the opening 68 to be placed against the inside of the outer layer 42B. It is contemplated that the deformable element 16 can be placed in the opening 68 either before or after it is attached to the base 14 by the snapping in place of the anchors 20 in the anchor receptacles 24 and thus the pins 38 into the apertures 36. FIG. 13 depicts the deformable element 16 (with the heel piece 18) being placed in the opening 68 before the deformable element is attached to the base 14. In this manner, the deformable element 16 is placed in the opening 68 without any initial bias in the deformable element 16. Stated differently, the deformable element 16 (with the heel piece 18) is placed at a first side of the outer layer 42B, which is the side proximate the foot-receiving cavity 46 (e.g., the inner side). The deformable element 16 is placed proximate to the inner surface 70 of the outer layer 42B, the inner surface 70 facing the foot-receiving cavity 46. Adhesive may be used to secure the deformable element within the opening 68 by applying adhesive wherever the deformable element 16 engages the inner surface 70 of the outer layer 42B and the inner surface 72 of the inner layer 42A. Because the apertures 60A, 60B, and 60C are arranged in the same spacing as the pegs 12A, 12B, 12C respectively, the deformable element 16 (with the heel piece 18) can be inserted in the opening 68 with the pegs 12A, 12B, 12C extending outward toward the outer layer 42B, and the deformable element 16 may be placed against the inside of the outer layer 42B with the apertures 60A, 60B, and 60C, aligned with the pegs 12A, 12B, and 12C. The pegs 12A, 12B, and 12C, can be inserted through the apertures 60A, 60B, and 60C, respectively, by slipping the flexible outer layer 42B over the pegs 12A, 12B, and 12C, so that the pegs 12A, 12B, and 12C extend through the outer layer 42B and are exposed at an exterior surface 74 of the outer layer 42B (also referred to as the outer surface 74 of the outer layer 42B). The outer surface 74 faces away from the foot-receiving cavity 46.

Figure 14:
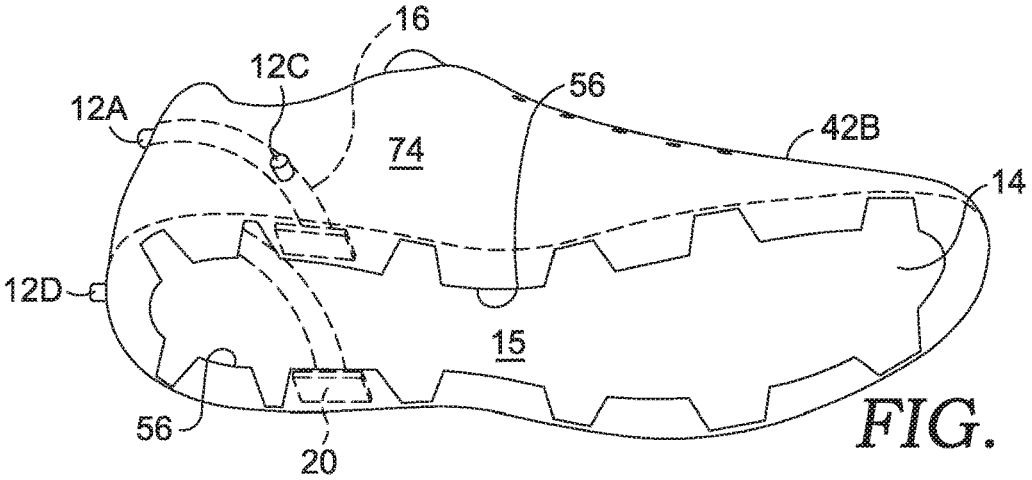
FIG. 14 is a side perspective view of the deformable element attached to the base and the upper attached to the deformable element and the base.

As shown in FIG. 14 after the deformable element is positioned in the opening 68 and the pegs 12A, 12B and 12C are positioned in their respective apertures 60A, 60B and 60C, the deformable element 16 can be attached to the base 14 by snapping the anchors 20 into their respective anchor receptacles 24 and thus the pins 38 into their respective apertures 36. In addition to the friction fit between the anchors 20 and the receptacles 24, adhesive can also be applied to the surfaces of the anchors 20 and the receptacles 24. The base 14 can be made of a rigid material such a rigid plastic or metal plate. The base 14 can have a lower surface 15 that is used to secure the upper 42 to the base 14 by use of the tabs 56 being folded over onto the surface and secured thereto by any suitable adhesive. Additionally, the attachment of the base 14 to the deformable element 16 and the attachment of the tabs 56 of the upper 42 may take place with the upper 42 positioned on or off a last. Still further, it may be desirable for the deformable element 16 to be in a partially biased position with the heel structure in the uncollapsed configuration 32. The initial biasing in the deformable element 16 can be accomplished by positioning the peg 12D of the base 14 within the aperture 60D of the outer layer 42B and thereafter, securing the tabs 56 onto the lower surface 15 of the base 14 by for instance the use of an adhesive as depicted in FIG. 14. This construction can be accomplished after the deformable element 16 has been secured to the base 14. The distance between the apertures 60A and apertures 60D can of such distance that when the pegs 12A and 12D are position therein, the deformable element 16 is biased slightly downward. This initial bias can exist when the heel structure 10 is in the uncollapsed configuration 32. The above description provides for the insertion of the deformable element 16 (with the heel piece 18) in the opening 68 prior to the attachment of the deformable element 16 to the base 14 with the anchors 20 and receptacles 24. As is apparent, the positioning of the deformable element within the opening 68 can also occur after the deformable element 16 is attached to the base 14. This configuration would include positioning of the pegs 12A, 12B, 12C and 12D in their respective apertures 60A, 60B, 60C and 60D at relatively the same time and thereafter securing the heel structure 10 to the upper 42 via the tabs. This attachment configuration with the deformable element 16 preattached to the base 14 can also result in an initial biasing of the deformable element.

The opening 68 can then be closed by securing the lower edge 66 of the inner layer 42A to the outer layer 42B, or to a strobel or to the upper side of the base 14 near the tabs 56. With the inner layer 42A secured, the deformable element 16 (with the heel piece 18) is disposed between the inner layer 42A and the outer layer 42B. The inner layer 42A is disposed inward of the heel structure 10, between the heel structure 10 and the foot-receiving cavity 46. The heel structure 10 is configured to surround a portion of a foot-receiving cavity 46 at the heel region 50.

Figure 15:
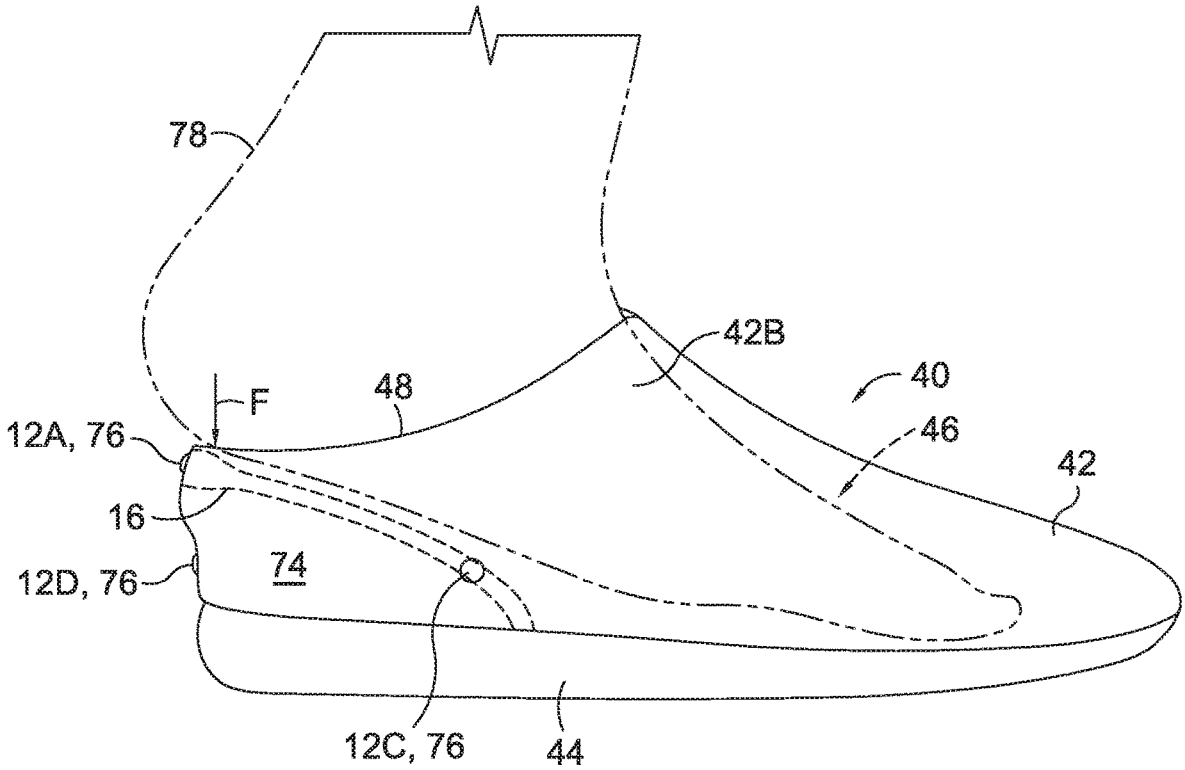
FIG. 15 is a lateral side view of the article of footwear with a foot shown in phantom depressing the heel structure during insertion and showing head portions of the pegs secured to the outer layer of the upper.

In FIG. 15, the pegs 12A, 12B, 12C, and 12D extend outward of the outer layer 42B. However, the pegs 12A, 12B, 12C, and 12D are roughly the same size diameter or smaller in diameter than the apertures 60A, 60B, 60C, and 60D. In order to further secure the device 10 in position relative to the upper 42, the pegs 12A, 12B, 12C, and 12D are secured at the exterior surface 74 of the outer layer 42B at the apertures 60A, 60B, 60C, and 60D. More specifically, the material at the ends of each of the pegs 12A, 12B, 12C, and 12D is melted and shaped to form a head portion of the peg that is larger than the aperture and larger than the remaining shaft portion that extends through the aperture. The melted material forms enlarged head portions 76 of the pegs 12A-12D shown in FIGS. 15 and 16. The enlarged head portions 76 may also be referred to as broadened heads. In some implementations, the melted material of the enlarged head portions 76 may bond to the exterior surface 74 around the apertures 60A, 60B, 60C, 60D when it cools. The formation of the enlarged head portions 76 of the pegs is described further with respect to FIGS. 17-21. Bonding the head portions 76 to the outer layer 42B may occur while the upper 42 and heel structure 10 are on a last. Next, a sole structure 44 can then be secured to a lower periphery of the upper 42, to a strobel, and/or to the bottom side 15 of the base 14 of the heel structure 10. Alternatively, the heel structure 10 may be inserted between the layers of the upper 42 as shown in FIGS. 9-14, and bonding the head portions 76 to the outer layer 42B may occur after the upper 42 has been lasted, secured to the sole structure 44 on the last, and removed from the last.

FIG. 15 shows a foot 78 shown in phantom applying a force F on the heel piece 18 of the heel structure 10, moving the heel structure 10 to the loaded position. Because the upper 42 is secured to the heel structure 10 at the pegs 12 by the head portions 76, the upper 42 folds downward with the heel structure 10 at the heel region 50, causing the ankle opening 48 to extend further rearward and downward when the deformable element 16 is in the loaded position than when the deformable element 16 is in the unloaded position shown in FIG. 16. When the foot 78 is moved forward and downward into the foot-receiving cavity 46, the bias of the deformable element 16 returns the deformable element 16 to the unloaded position of FIG. 16. As describe above, it one aspect hereof, the deformable element 16 may have an initial bias when in the unloaded position of FIG. 16.

Figure 17:
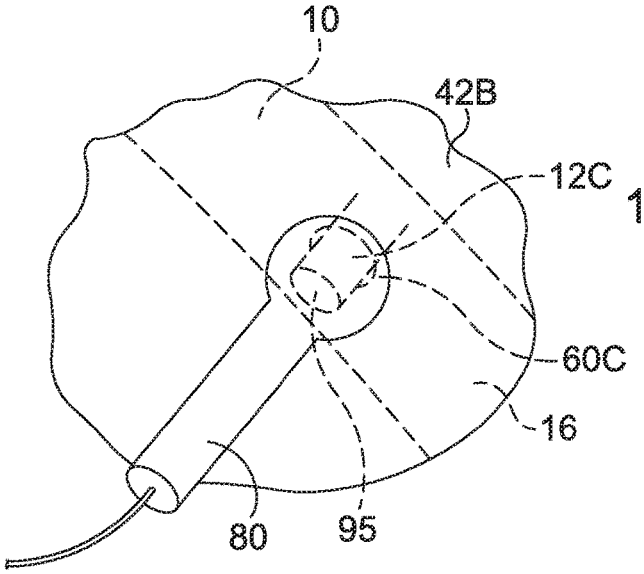
FIG. 17 is a fragmentary perspective view of the article of footwear and a tool heating an end of one of the pegs of the heel structure.
Figure 18:
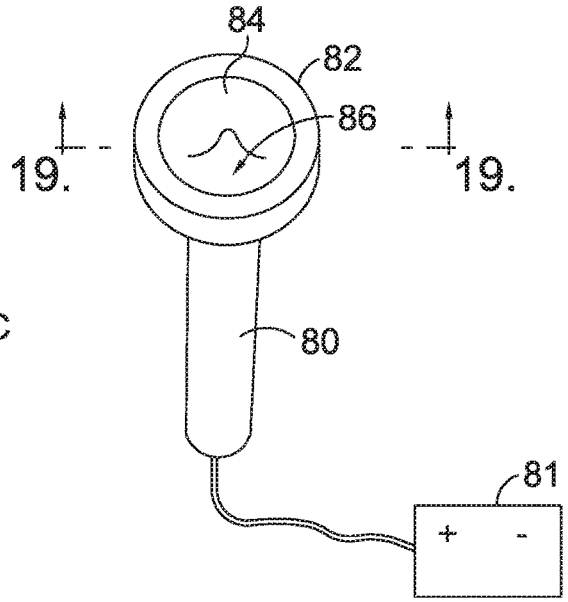
FIG. 18 is a perspective view of the tool.
Figure 21:
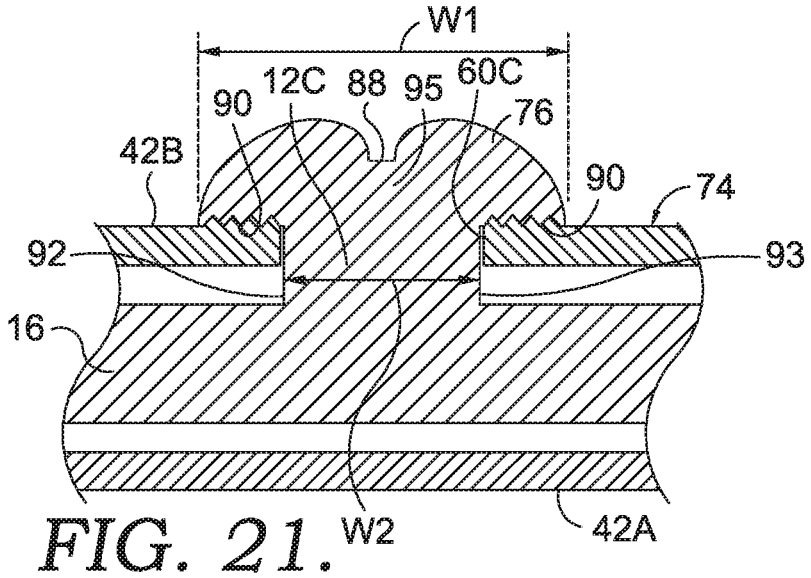
FIG. 21 is a fragmentary cross-sectional view of the peg and upper of FIG. 20 taken at lines 21-21 in FIG. 20.

FIG. 17 shows a tool 80 being used to melt the material at the end of the peg 12C to form the head portion 76, shown in FIG. 21. The tool 80 may be, for example, an ultrasonic welding tool that converts electrical power into ultrasonic vibrations that create sufficient friction to generate heat, causing the material of the peg 12C to melt. FIG. 18 shows the tool 80 powered by a power source 81 such as a battery or an electrical outlet. One example tool 80 is an ultrasonic welding tool available as the Dukane iQ Ultrasonic Welder available from Dukane Corporation of Saint Charles, Illinois USA.

Figure 19:
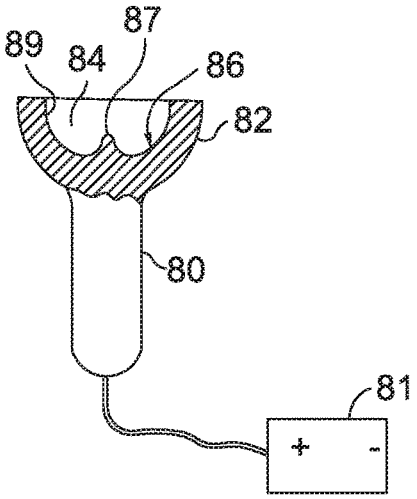
FIG. 19 is a partial cross-sectional view of the tool taken at lines 19-19 in FIG. 18.
Figure 20:
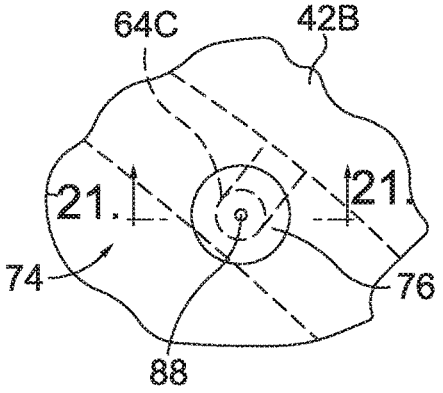
FIG. 20 is a fragmentary perspective view of the article of footwear with a head portion of the peg secured to an exterior surface of the upper via the tool of FIG. 17.

The tool 80 has an end 82 forming a mold cavity with a mold surface 86. As shown in FIG. 19, the mold cavity 84 is generally hemispherical, with a central protrusion 87 in the mold surface 86. FIG. 19 shows that the mold cavity 84 and mold surface 86 shape the melted material into a head portion 76 with a central recess 88. The end 82 has a circular opening 89 to the cavity 84. The circular opening 89 has a larger diameter than the peg 12C prior to melting of the end of the peg 12C. Accordingly, when the tool 80 is pressed against the exterior surface 74, the material of the peg 12C melts and then cools as the tool 80 is powered off. As the tool 80 remains in place against the outer layer 42B for a predetermined cooling time, the melted material will melt against and may thereby bond to the exterior surface 74 of the outer layer 42B around the aperture 60C, as illustrated at bonded areas 90 in FIG. 21. The melted material is referred to as the head portion 76 or broadened head. The head 76 extends from the remainder of the original, unmelted portion of the peg 12C, which is referred to as the shaft portion 92 or as a stem 92. The shaft portion 92 and the head portion 76 are of unitary, integral construction. The shaft portion 92 extends from a first end 93 joined with the deformable element 16 to a distal end 95 (also shown in FIG. 21) spaced apart from the first end 93 and which protrudes through the outer layer 42B at the aperture 60C to a second side of the outer layer 42B. The outer layer 42B is sufficiently pliable to allow the shaft portion 92 to be inserted through the aperture 60C to extend through the outer layer 42B so that the distal end 95 protrudes from the outer layer 42B. For example, the outer layer 42B is sufficiently pliable so that the shaft portion 92 may be manually (or by robotic machine) caused to extend through the first layer 42B. The shaft portion 92 extends through the first layer 42B from the first side of the first layer 42B and protrudes from the first layer 42B at the second side of the outer layer 42B. Additionally, in some implementations, the outer layer 42B may not have pre-formed apertures in the first spacing, but may be sufficiently pliable to allow the shaft portion 92 to either stretch or pierce the material of the outer layer 42B. After the shaft portion 92 is caused to extend through the first layer 42B and protrude at the outer side, the tool 80 may be hand held, and pressed against the exterior surface 74 at each peg 12 one at a time to melt the material of the shaft portion 92 at the distal end 95, forming a head portion 76 at each peg 12. The head portion 76 provided at the distal end 95 has a width W1 greater than a width W2 of the corresponding aperture 60C through which the shaft portion 92 extends.

The outer layer 42B is a first material having a first melt temperature, and the peg 12, or at least the material at the distal end 95 of the peg 12 that is melted to form the head portion 76, is a second material having a second melt temperature lower than the first melt temperature. The burn temperature of the first material of the outer layer 42B is also higher than the melt temperature of the second material of the peg 12. Accordingly, melting the material of the peg 12 at the distal end 95 to form the head portion 76 with the tool 80 will not cause the outer layer 42B to either melt or burn, even if the head portion 76 bonds to the outer layer 42B.

Figure 22:
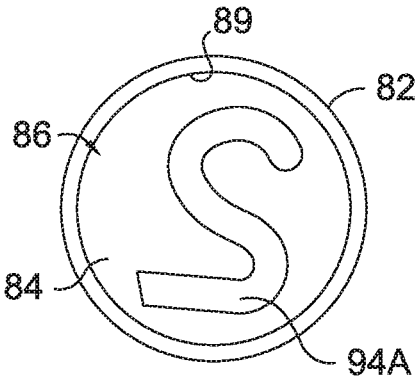
FIG. 22 is a plan view of a mold surface of the tool of FIG. 17.
Figure 23:
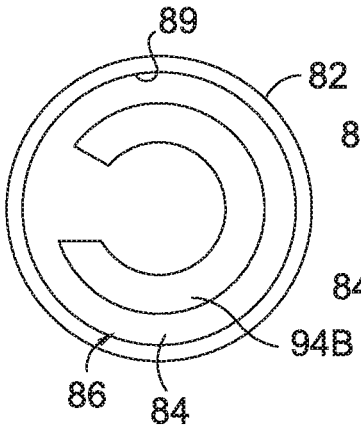
FIG. 23 is a plan view of another mold surface for the tool of FIG. 17.
Figure 24:
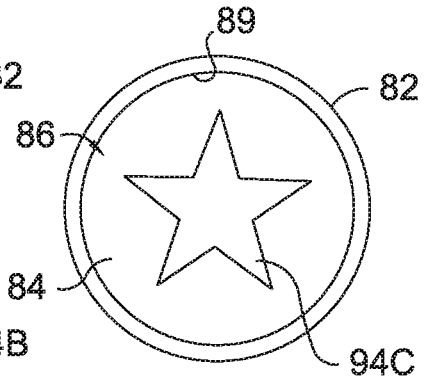
FIG. 24 is a plan view of another mold surface for the tool of FIG. 17.
Figure 25:
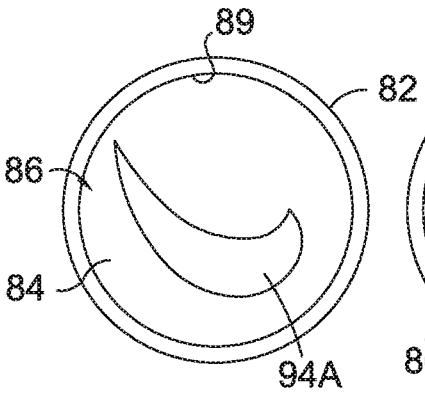
FIG. 25 is a plan view of another mold surface for the tool of FIG. 17.
Figure 26:
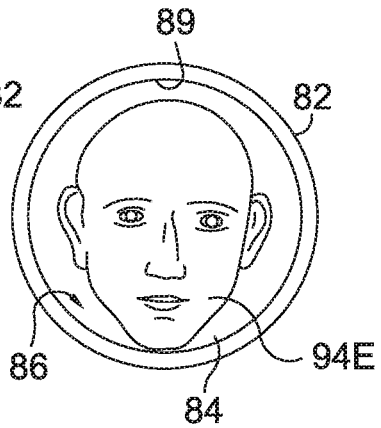
FIG. 26 is a plan view of another mold surface for the tool of FIG. 17.
Figure 27:
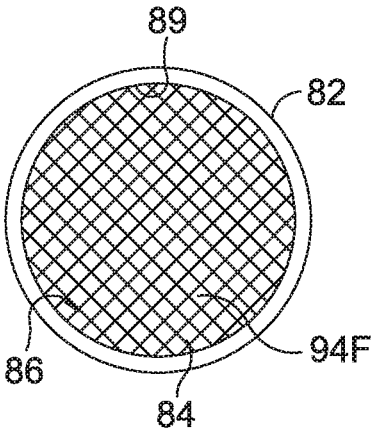
FIG. 27 is a plan view of another mold surface for the tool of FIG. 17.

The head portion 76 may have various shapes or textures in order to achieve structural integrity of the bond to the outer layer 42B, to achieve a particular aesthetic, or both. For example, the mold cavity 84 and mold surface 86 affect the final shape of the head portion 76. Providing a circular opening enables bonding of the melted material around the entire perimeter of the aperture 60C. The opening 89 could have other shapes, such as a square, a triangle, a star, etc. The mold cavity and mold surface provide a generally hemispherical shape of the head portion 76. In other embodiments, the outer surface of the head portion 76 furthest from the exterior surface 74 could be generally flat, such as head portion shaped as a flat nail head. Additionally, the mold surface 86 can have protrusions or recessions that create a shape on the surface of the head portion 76. FIG. 22 shows a recess or protrusion 94A in the shape of a reversed number 2 that will result in a number 2 on the surface of the head portion 76. FIG. 23 shows a recess or protrusion 94B in the shape of a reversed letter C that will result in a letter C on the surface of the head portion 76. FIG. 24 shows a recess or protrusion 94C in the shape of an object that is a star that will result in a star on the surface of the head portion 76. FIG. 25 shows a recess or protrusion 94D in the shape of a symbol or logo that will result in the shape of the symbol or logo on the surface of the head portion 76. FIG. 26 shows recesses and protrusions 94E in a design that is a face and that will result in the image of the face on the surface of the head portion 76. FIG. 27 shows recesses or protrusions 94F depicting a cross-hatch pattern and texture, and that will result in a cross-hatch pattern and texture on the surface of the head portion 76.

According to the method of manufacturing the article of footwear 40, the heating tool 80 may be selected from a group of tools each having a mold surface 86 with a different shape depicting at least one of a number, a letter, a symbol, a logo, an object, a design, and/or each having a different surface texture, examples of which are shown in FIGS. 19 and 22-27. Selecting the specific heating tool may be in response to a request for a head portion 76 with a specific shape or surface texture. The mold surface 86 of the heating tool 80 selected may have the specific shape or surface texture. The resulting head portion 76 of the peg 12 made with the selected heating tool 80 will then have the requested specific shape, which may depict at least one of a number, a letter, a symbol, a logo, an object, or a design, or the requested specific surface texture. The request may also be for the head portions 76 to be a specific color, and the heel structure 10 may be manufactured with a material having the requested specific color. Additionally, the pegs 12 need not be the same, and the request may include that one or more of the pegs 12 depict a different number, letter, symbol, logo, object, design, or different surface texture or color than one or more of the other pegs 12.

Figure 28:
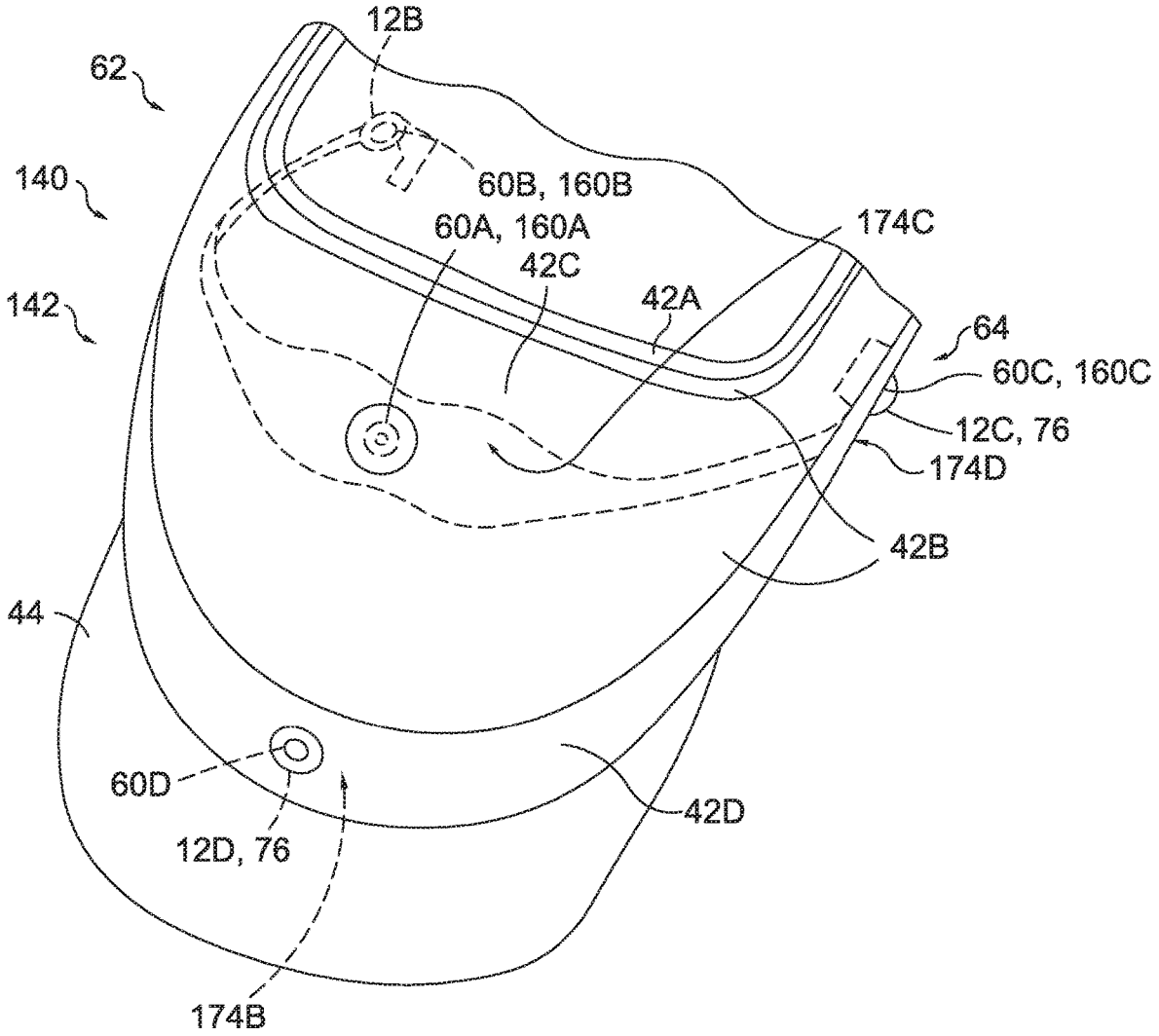
FIG. 28 is rear perspective and fragmentary view of another article of footwear with the heel structure.

In some embodiments, the upper may have multiple outer layers (e.g., layers outward of the heel structure 10), and the pegs 12 may extend through some or all of these outer layers. For example, FIG. 28 shows a rear portion of another article of footwear 140. The article of footwear 140 has an upper 142 that includes multiple outer layers. The upper 142 includes the inner layer 42A and the outer layer 42B. Additionally, the upper 142 includes an outer layer 42C secured to the outer layer 42B. The outer layer 42C also has an aperture 160A that is aligned with the aperture 60A of the outer layer 42B. The peg 12A extends through both apertures, and the head portion 76 of the peg 12A is melted to form a head portion 76 disposed at the exterior surface 174C, and which may secure against (e.g., bond to) the exterior surface 174C of the outer layer 42C. Similarly, at the lateral side 64, the peg 12C extends through an aperture 160C in outer layer 42D as well as through the aperture 60C (see FIG. 13) in outer layer 42B so that the head portion 76 is disposed at the exterior surface 174D and may be secured to the exterior surface 174D of the outer layer 42D. The head portion 76 of peg 12B is similarly disposed at the medial side 62 at an aperture 160B in outer layer 42D that is aligned with the aperture 60B. In contrast, the head portion 76 of peg 12D is disposed at and possibly bonded to the exterior surface 174B of the outer layer 42B, just as in FIG. 13, and the outer layer 42D extends over and covers the head portion 76 of peg 12D. The outer layer 42D protects the head portion 76 of the peg 12D. The head portion 76 of the peg 12D may instead be disposed lower on the article of footwear 150 such that it is covered by the rear of the sole structure 44. In either case, the head portion 76 may have the hemispherical shape resulting from mold cavity 84, or may have another shape. For example, the head portion 76 may have a generally flat outer surface, such as that of a flat nail head, in order to minimize distortion of the outer layer 52D or the sole structure 44.

Figure 29:
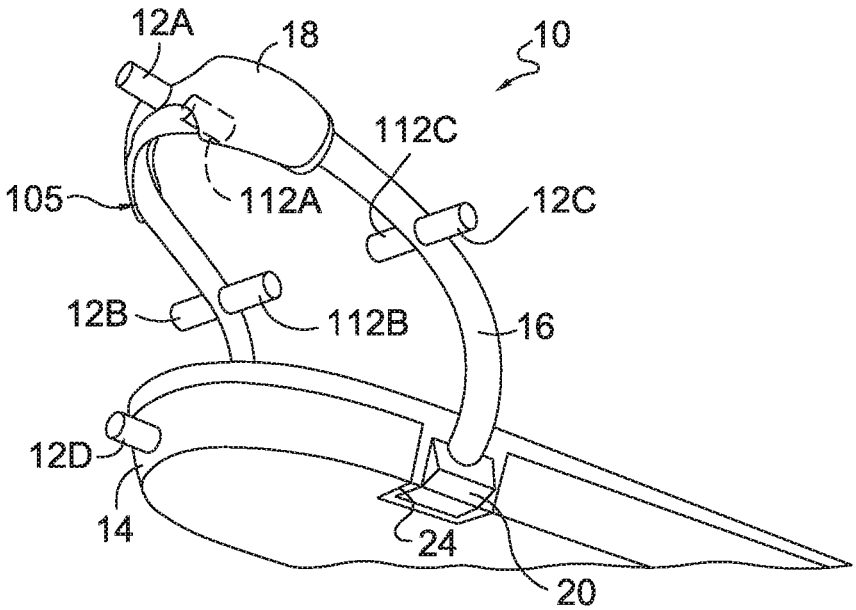
FIG. 29 is a rear perspective view of another heel structure.

With reference to FIG. 29, an additional aspect hereof is depicted. The additional aspect includes further pegs 112A, 112B and 112C which extend inwardly from the deformable element 116. Thus, the deformable element 16 includes the outward pegs 12A, 12B, 12C, and 12D and the inward pegs 112A, 112B and 112C. The pegs 112A, 112B and 112C can be positioned in appropriate apertures in the inner layer 42A of the upper 42 and can be formed with appropriate head portions 76. The head portions 76 are formed in the same manner as described above with the heating tool 80.

Figure 30:
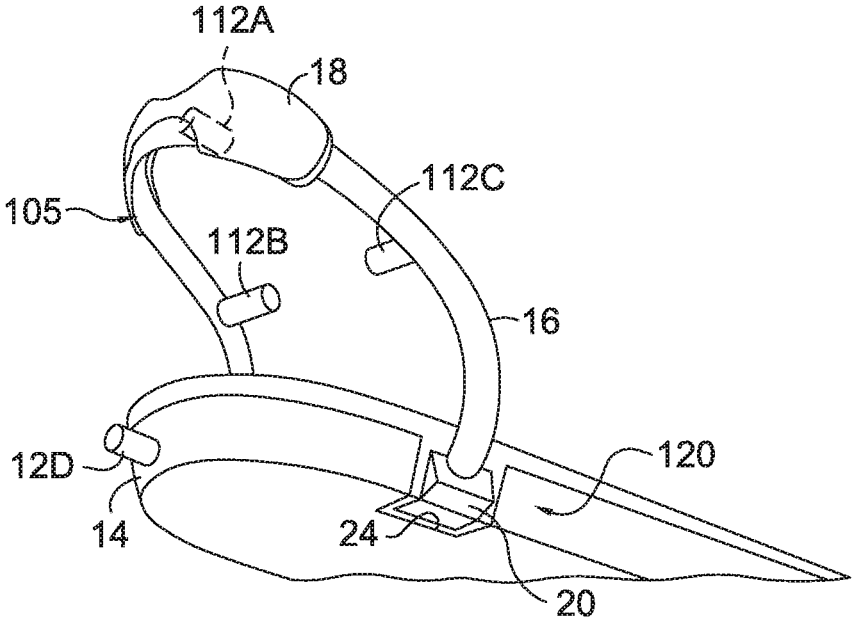
FIG. 30 is a rear perspective view of a yet further heel structure.

A still further aspect hereof is depicted in FIG. 30. This aspect includes only the inwardly facing pegs 112A, 112B and 112C. The pegs 112A, 112B and 112C are received in appropriate apertures in the inner layer 42A and have corresponding head portions 76. Again, the head portions 76 are formed in the same manner described above with the heating tool 80.

With reference to FIGS. 9-11, an aspect hereof to connect the deformable element 16 to the base 14 will be described. More specifically, in order to secure the anchors 20 to the anchor receptacles 24, the pins 38 of the anchor receptacles 24 may have head portions 39 extending beyond the apertures 36 of the anchors 20 as depicted in FIG. 11. Thus, in addition to the friction fit between the pins 38 and the apertures 36, the heating tool 80 or a similar heating tool may be used to melt a head portion 39 of each pin 38 similar to head portion 76 of the pegs 12 so that the anchor 20 of the deformable element 16 is securely positioned within its respective anchor receptacle 24 of the base 14.

Figure 31:
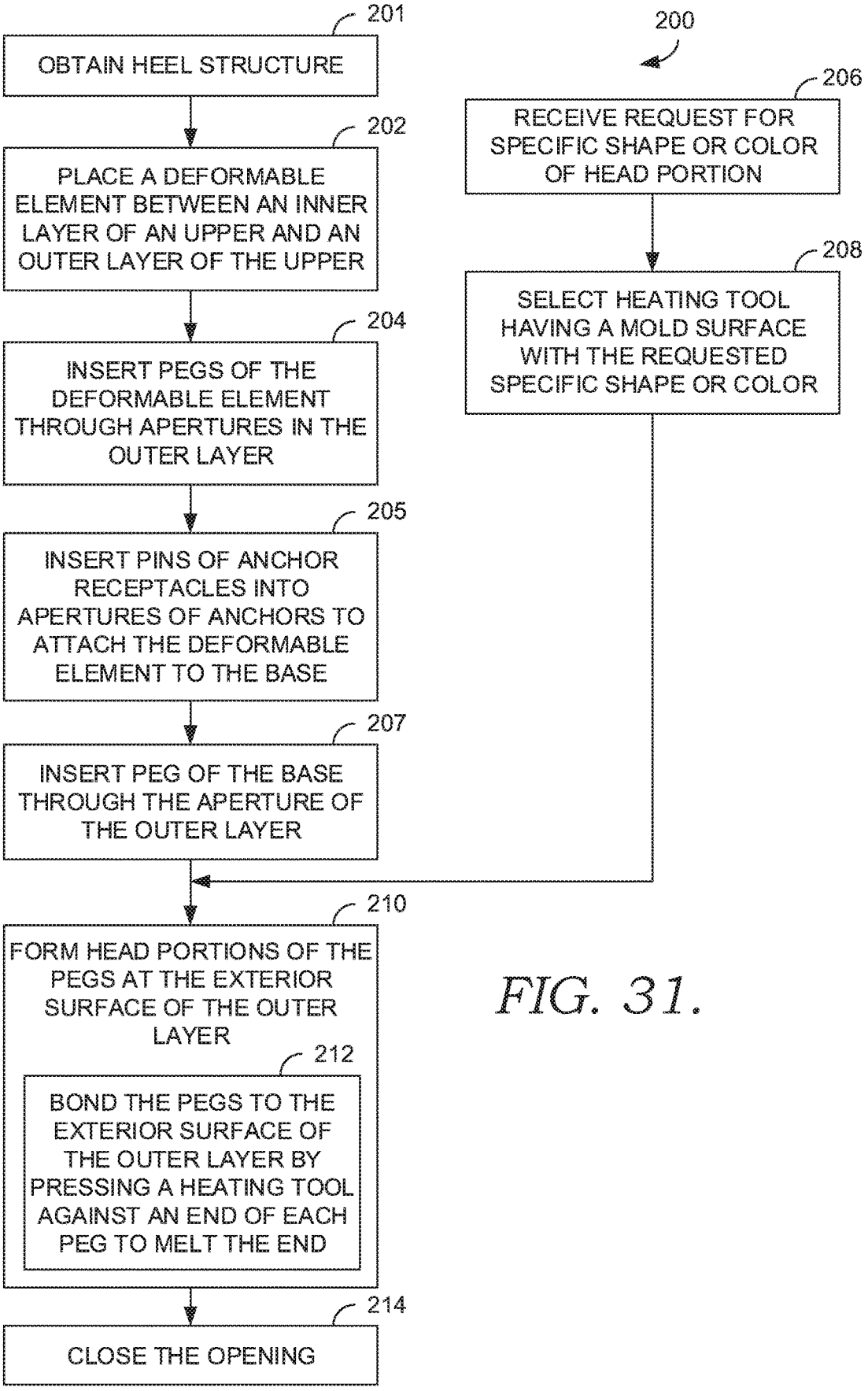
FIG. 31 is a flow chart of a method of manufacturing an article of footwear.

FIG. 31 is a flow chart of a method of manufacturing an article of footwear described herein, such as the article of footwear 40 or the article of footwear 140, and is referred to as the method of manufacturing 200. The method of manufacturing 200 is described with respect to the article of footwear 40. The method begins with step 201, obtaining a footwear element, such as the heel structure 10, that has a peg 12 and a stem (e.g., shaft portion 92). The heel structure includes a deformable element 16 and a base 14 that will eventually be attached together. The method of manufacturing 200 may then proceed to step 202, placing the deformable element 16 between an inner layer and an outer layer of an upper. For example, step 202 may be carried out by placing a deformable element 16 of a heel structure 10 between the inner layer 42A and the outer layer 42B of upper 42. Once the deformable element 16 is placed between the layers 42A, 42B, the method moves to step 204, causing the stem 92 to extend through the first layer (outer layer 42B) of the upper 42 and protrude from the first layer (e.g., at the exterior surface 74), such as by inserting pegs that extend outward from the deformable element between the inner layer and the outer layer. For example, the pegs 12 of the heel structure 10 may be inserted through apertures 60A, 60B, and 60C in the outer layer 42B. The apertures 60A, 60B, and 60C and the pegs 12 may both be arranged in a first arrangement (e.g., they both have the same relative spacing).

Further, the method of manufacturing 200 may include a step 205 of inserting the pins 38 of the anchor receptacles 24 into the apertures 36 of the anchors 20 to secure the deformable element 16 to the base 14.

Still further, the method 200 includes the step 207 of inserting a peg 12D of the base 14 of the heel structure 10 within the aperture 60D of the outer layer 42B.

Additionally, the method of manufacturing 200 may enable the head portions 76 of the pegs 12 to be customized. For example, in step 206, the manufacturer may receive a request for a heel support device with one or more head portions having a specific shape, a specific surface texture, and/or a specific color. The request may be for a specific shape of one or more of the head portions 76 of the heel support device 10, such as a shape depicting at least one of a number, a letter, a symbol, a logo, an object, a design, or for a head portion 76 with a specific surface texture, or for a head portion 76 with a specific color, as discussed herein. The request may be received directly from a consumer purchasing the article of footwear 50, or may be received from an entity who will sell the footwear 50 to the customer. Under step 208, in response to the request received in step 206, the manufacturer may then select a specific heating tool that has a mold surface with the requested specific shape or surface texture such as by selecting a specific heating tool 80 for the heel support device 10, and if a specific color is requested, may use a material of the specific color for the heel support device.

Either following step 208 or, in the absence of steps 206 and 208, then directly following step 204, the method of manufacturing 200 moves to step 210, in which the head portions 76 of the pegs 12 are formed at the exterior surface of the outer layer. For example, step 210 may be accomplished according to sub-step 212, in which a heating tool 80 is pressed against a distal end 95 of each of the pegs 12 at the exterior surface 74 to melt the distal end 95, forming the head portion 76. The melted end (e.g., the head portion 76) may also bond to the exterior surface 74 of the outer layer 42B when it melts, thereby bonding the pegs 12 to the exterior surface 74 of the outer layer 42B.

The method of manufacturing 200 may also include step 214, closing an opening between the inner layer and the outer layer through which the heel support device was inserted in step 202, such as by closing opening 68 between inner layer 42A and outer layer 42B. Step 214 occurs after steps 202 and 204, and may occur either before or after steps 206 and 208.

The following clauses provide example configurations of an article of footwear, heel structure, and a method of manufacturing disclosed herein.

Clause 1. An article of footwear comprising: an upper including an inner layer and an outer layer, and defining a foot-receiving cavity inward of the inner layer, wherein the outer layer defines at least one aperture; a heel structure having a deformable element attached to a rigid base, wherein the deformable element is capable of movement between an uncollapsed configuration and a collapsed configuration with respect to the base, wherein the deformable element is disposed between the inner layer and the outer layer and the inner layer is disposed between the deformable element and the foot-receiving cavity; and at least one peg extending outward from at least one of the deformable element, and the base, and extending through the aperture in the outer layer, wherein the peg is secured at a surface of the upper.

Clause 2. The article of footwear of clause 1, wherein: the outer layer includes a plurality of apertures; the deformable element includes a medial portion, a lateral portion, and a heel piece; a first peg extends outward from the heel piece and is positioned in a respective aperture in the outer layer; a second peg extends outward from the medial portion and is positioned in a respective aperture in the outer layer; a third peg extends outward from the lateral portion and is positioned in a respective aperture in the outer layer; and each of the pegs is secured at a surface of the upper.

Clause 3. The article of footwear of clause 1 or clause 2, wherein: each of the pegs includes a shaft portion and a head portion of unitary, integral construction with the shaft portion; the shaft portion extends through one of the apertures of the upper; and the head portion is bonded at the surface of the upper.

Clause 4. The article of footwear of clause 3, wherein the head portion depicts at least one of a number, a letter, a symbol, a logo, an object, or a design.

Clause 5. The article of footwear of clause 1, wherein a peg extends outward from a peripheral portion of the rigid base.

Clause 6. The article of footwear of clause 1, clause 2 or clause 5, wherein the deformable element is disposed between the outer layer and the inner layer prior to the attachment of the deformable element to the base.

Clause 7. The article of footwear of clause 1, clause 2, clause 5, or clause 6, wherein: the base includes an anchor receptacle located on the medial side of the base and another anchor receptacle located on the lateral side of the base; each of the anchor receptacles includes at least one pin; the deformable element includes an anchor located on the medial side of the element and an anchor located on the lateral side of the element; and each of the anchors includes at least one aperture for receiving a respective pin of the anchor receptacle.

Clause 8. The article of footwear of clause 1, clause 2, or clause 5, wherein the deformable element is disposed between the outer layer and the inner layer after the attachment of the deformable element to the base.

Clause 9. The article of footwear of clause 6 or clause 8, wherein the outer layer includes a plurality of tabs extending from a lower edge of the outer layer and wherein the tabs are used to secure the upper to the rigid base.

Clause 10. A method of manufacturing an article of footwear, the method of manufacturing comprising: placing a deformable element between an inner layer of an upper and an outer layer of the upper; wherein the deformable element includes at least one peg extending outward toward the outer layer; inserting the at least one peg of the deformable element through the outer layer of the upper so that the at least one peg extends through the outer layer and is exposed at an exterior surface of the outer layer; attaching the deformable element to a rigid base utilizing at least one aperture on the deformable element that receives at least one pin extending from the base; and securing the at least one peg at the exterior surface of the outer layer.

Clause 11. The method of manufacturing of clause 10, wherein: the at least one peg includes multiple pegs, and the outer layer of the upper includes multiple apertures; the pegs are spaced apart from one another in a first arrangement; and the apertures are spaced apart from one another in the first arrangement so that the apertures align with the pegs.

Clause 12. The method of manufacturing of clause 10, wherein securing the at least one peg at the exterior surface of the outer layer comprises bonding the at least one peg to the exterior surface of the outer layer.

Clause 13. The method of manufacturing of clause 12, wherein bonding the at least one peg to the exterior surface of the outer layer comprises: pressing a heating tool against an end of the at least one peg at the exterior surface of the outer layer to melt the end against the exterior surface of the outer layer.

Clause 14. The method of manufacturing of clause 13, wherein the heating tool has a mold surface that shapes a head portion of the at least one peg at the exterior surface of the outer layer, the pressing the heating tool to melt the end creates the head; and the method of manufacturing further comprising: selecting the heating tool from a group of heating tools each having a mold surface with a different shape depicting at least one of a number, a letter, a symbol, a logo, an object, or a design, or with a different surface texture.

Clause 15. The method of manufacturing of clause 14, wherein selecting the heating tool is in response to a request for a specific shape or a specific surface texture of the head; and wherein the mold surface of the heating tool selected has the specific shape or the specific surface texture requested.

Clause 16. The method of manufacturing of any of clauses 10-15, wherein placing the deformable element between the inner layer of the upper and the outer layer of the upper is through an opening between the inner layer and the outer layer; and the method of manufacturing further comprising: after placing the footwear element between the inner layer and the outer layer, closing the opening.

Clause 17. The method of manufacturing of any of clause 13-15, wherein the attaching the deformable element to a base utilizing at least one aperture on the deformable element that receives at least one pin extending from the base includes using a heating element on a respective pin to enhance the attachment of the deformable element to the base.

Clause 18. The method of manufacturing of any of clauses 10-12 wherein the base has one or more pegs extending from a periphery of the base and extending through the outer layer.

Clause 19. The method of manufacturing of clause 10, clause 11 or clause 18, wherein the pegs and the apertures are used to provide an initial bias to the deformable member when the deformable member is in an uncollapsed configuration.

Clause 20. The method of manufacturing of clause 10 or clause 18, wherein the outer layer includes a plurality of tabs extending from a lower edge and the tabs are used to secure the base to the upper.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

The invention claimed is:

1. A method of manufacturing an article of footwear having at least an upper with an ankle collar and a sole structure, the ankle collar movable between a lowered position closer to the sole and a raised position farther from the sole, the method of manufacturing comprising: positioning a deformable element in the article of footwear to bias the ankle collar to the raised position, positioning at least one outwardly extending peg of the deformable element through the upper the upper; inserting the at least one peg of the deformable element through the outer layer of the upper so that the at least one peg extends through the outer layer and is exposed at an exterior surface of the outer layer; and attaching a lower portion of the deformable element to the sole structure; and securing the at least one peg at the exterior surface of the outer layer; wherein: the at least one peg includes multiple pegs, and the outer layer of the upper includes multiple apertures; the pegs are spaced apart from one another in a first arrangement; and the apertures are spaced apart from one another in the first arrangement so that the apertures align with the pegs.

2. The method of manufacturing of claim 1, wherein positioning the pegs and the apertures in the first arrangement imparts a biasing force on the deformable member when the deformable member is in an uncollapsed configuration.

3. The method of manufacturing of claim 2, wherein securing the at least one peg at the exterior surface of the outer layer comprises bonding the at least one peg to the exterior surface of the outer layer.

4. The method of manufacturing of claim 3, wherein bonding the at least one peg to the exterior surface of the outer layer comprises pressing a heating tool against an end of the at least one peg at the exterior surface of the outer layer to melt the end against the exterior surface of the outer layer.

5. The method of manufacturing of claim 4, wherein the heating tool has a mold surface that shapes a head portion of the at least one peg at the exterior surface of the outer layer, the pressing the heating tool to melt the end creates the head; and the method of manufacturing further comprising:

selecting the heating tool from a group of heating tools each having a mold surface with a different shape depicting at least one of a number, a letter, a symbol, a logo, an object, or a design, or with a different surface texture.

6. The method of manufacturing of claim 5, wherein selecting the heating tool is in response to a request for a specific shape or a specific surface texture of the head; and wherein the mold surface of the heating tool selected has the specific shape or the specific surface texture requested.

7. The method of manufacturing of claim 1, wherein the attaching lower portion of the deformable element to the sole structure includes heating at least a portion of the lower portion to thermally couple the lower portion to the sole structure.

8. The method of claim 1, wherein the securing the at least one peg at the exterior surface of the outer layer includes thermally deforming a distal end of the at least one peg at the exterior surface of the outer layer.

* * * * *